US009254026B2

(12) United States Patent
Yamasaki

(10) Patent No.: US 9,254,026 B2
(45) Date of Patent: Feb. 9, 2016

(54) DRAWING APPARATUS AND DRAWING METHOD THEREOF

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/543,323

(22) Filed: Nov. 17, 2014

(65) Prior Publication Data

US 2015/0138264 A1 May 21, 2015

(30) Foreign Application Priority Data

Nov. 21, 2013 (JP) ..... 2013-240691

(51) Int. Cl.
*B41J 2/045* (2006.01)
*A45D 29/00* (2006.01)

(52) U.S. Cl.
CPC ..... *A45D 29/00* (2013.01)

(58) Field of Classification Search
CPC .. B41J 2/04541; B41J 2/04543; B41J 2/0458; B41J 2/04581; B41J 2/04588
USPC ..... 347/9, 101, 107–109
See application file for complete search history.

(56) References Cited

U.S. PATENT DOCUMENTS 5,931,166 A * 8/1999 Weber et al. ..... 132/73
6,286,517 B1 * 9/2001 Weber et al. ..... 132/73
6,336,694 B1 * 1/2002 Ishizaka ..... 347/2

FOREIGN PATENT DOCUMENTS

JP 2003534083 A 11/2003

* cited by examiner

*Primary Examiner* — Manish S Shah
*Assistant Examiner* — Roger W Pisha, II
(74) *Attorney, Agent, or Firm* — Holtz, Holtz & Volek PC

(57) ABSTRACT

A drawing apparatus, including: a drawing unit which performs drawing of a design by applying inks of plural types to a drawing target area of a drawing target; and a control unit which controls the drawing unit on basis of image data of the design; wherein the control unit sets a plurality of unit areas each of which has a contact part contacting with each other in the drawing target area on basis of the image data, and the control unit controls the drawing unit to perform drawing on a specific unit area of the plurality of the unit areas when the control unit determines that every unit area contacting with the specific unit area is at least a dried unit area for which drying of the applied ink is finished or an un-drawn unit area to which the ink is not applied.

10 Claims, 18 Drawing Sheets

FIG.7

825

| DRAWING DATA | AREA NO. |
|---|---|
| DRAWING DATA 1 | 1 |
| DRAWING DATA 2 | 2 |
| DRAWING DATA 3 | 3 |
| DRAWING DATA 4 | 4 |
| DRAWING DATA 5 | 5 |
| DRAWING DATA 6 | 6 |
| DRAWING DATA 7 | 7 |
| DRAWING DATA 8 | 8 |
| DRAWING DATA 9 | 9 |
| DRAWING DATA 10 | 10 |
| DRAWING DATA 11 | 11 |
| DRAWING DATA 12 | 12 |
| DRAWING DATA 13 | 13 |
| DRAWING DATA 14 | 14 |
| DRAWING DATA 15 | 15 |
| DRAWING DATA 16 | 16 |
| DRAWING DATA 17 | 17 |
| DRAWING DATA 18 | 18 |

FIG.8

826

| AREA NO. | SETTING VALUE OF DRYING TIME[sec] |
|---|---|
| 1 | 10 |
| 2 | 8 |
| 3 | 12 |
| 4 | 8 |
| 5 | 5 |
| 6 | 7 |
| 7 | 11 |
| 8 | 11 |
| 9 | 9 |
| 10 | 5 |
| 11 | 12 |
| 12 | 5 |
| 13 | 12 |
| 14 | 7 |
| 15 | 10 |
| 16 | 8 |
| 17 | 11 |
| 18 | 9 |

FIG.9

827

| AREA NO. | 1 | 2 | 3 | 4 | 5 | 6 | 7 | 8 | 9 | 10 | 11 | 12 | 13 | 14 | 15 | 16 | 17 | 18 |
|---|---|---|---|---|---|---|---|---|---|---|---|---|---|---|---|---|---|---|
| 1 | | ○ | | ○ | ○ | | | | | | | | | | | | | |
| 2 | ○ | | ○ | | ○ | ○ | ○ | | | | | ○ | | | | | | |
| 3 | | ○ | | | | | ○ | | | | | | | | | | | |
| 4 | ○ | | | | ○ | | | ○ | | | | | | | | | | |
| 5 | ○ | ○ | | ○ | | ○ | | ○ | | | | | | | | | | |
| 6 | | ○ | | | ○ | | | ○ | ○ | | ○ | ○ | | | | ○ | | |
| 7 | | ○ | ○ | | | | | | | | | ○ | | | | | | |
| 8 | | | | ○ | ○ | ○ | | | ○ | | | | ○ | | | | | |
| 9 | | | | | | ○ | | ○ | | ○ | | | ○ | | | | | |
| 10 | | | | | | ○ | | | ○ | | ○ | | ○ | ○ | | | | |
| 11 | | | | | | ○ | | | ○ | ○ | | | | ○ | ○ | ○ | ○ | |
| 12 | | ○ | | | | ○ | ○ | | | | | | | | | ○ | | ○ |
| 13 | | | | | | | | ○ | ○ | ○ | | | | ○ | | | ○ | |
| 14 | | | | | | | | | ○ | ○ | ○ | | ○ | | | | ○ | |
| 15 | | | | | | | | | | | ○ | | | | | ○ | ○ | |
| 16 | | | | | | ○ | | | | | ○ | ○ | | | ○ | | | ○ |
| 17 | | | | | | | | | | | ○ | | ○ | ○ | ○ | | | |
| 18 | | | | | | | | | | | | ○ | | | ○ | ○ | | |

FIG.10

828

| AREA NO. | DRAWING END FLAG | DRAWING ENABLE FLAG |
|---|---|---|
| 1 | 0 | 0 |
| 2 | 0 | 0 |
| 3 | 0 | 0 |
| 4 | 0 | 0 |
| 5 | 0 | 0 |
| 6 | 0 | 0 |
| 7 | 0 | 0 |
| 8 | 0 | 0 |
| 9 | 0 | 0 |
| 10 | 0 | 0 |
| 11 | 0 | 0 |
| 12 | 0 | 0 |
| 13 | 0 | 0 |
| 14 | 0 | 0 |
| 15 | 0 | 0 |
| 16 | 0 | 0 |
| 17 | 0 | 0 |
| 18 | 0 | 0 |

FIG.15

825

| DRAWING DATA | AREA NO. |
|---|---|
| DRAWING DATA 1 | 1 |
| DRAWING DATA 2 | 2 |
| DRAWING DATA 3 | 3 |
| DRAWING DATA 4 | 4 |
| DRAWING DATA 5 | 5 |
| DRAWING DATA 6 | 6 |
| DRAWING DATA 7 | 7 |
| DRAWING DATA 8 | 8 |
| DRAWING DATA 9 | 9 |

FIG.16

826

| AREA NO. | SETTING VALUE OF DRYING TIME[sec] |
|---|---|
| 1 | 10 |
| 2 | 8 |
| 3 | 12 |
| 4 | 8 |
| 5 | 5 |
| 6 | 7 |
| 7 | 11 |
| 8 | 11 |
| 9 | 9 |

FIG.17

827

| AREA NO. | 1 | 2 | 3 | 4 | 5 | 6 | 7 | 8 | 9 |
|---|---|---|---|---|---|---|---|---|---|
| 1 | | ○ | | | ○ | ○ | | | |
| 2 | ○ | | ○ | | | ○ | | | |
| 3 | | ○ | | ○ | | ○ | | | |
| 4 | | | ○ | | ○ | ○ | | | |
| 5 | ○ | | | ○ | | ○ | ○ | | |
| 6 | ○ | ○ | ○ | ○ | ○ | | | | |
| 7 | | | | | ○ | | | ○ | ○ |
| 8 | | | | | | | ○ | | |
| 9 | | | | | | | ○ | | |

FIG.18

828

| AREA NO. | DRAWING END FLAG | DRAWING ENABLE FLAG |
|---|---|---|
| 1 | 0 | 0 |
| 2 | 0 | 0 |
| 3 | 0 | 0 |
| 4 | 0 | 0 |
| 5 | 0 | 0 |
| 6 | 0 | 0 |
| 7 | 0 | 0 |
| 8 | 0 | 0 |
| 9 | 0 | 0 |

DRAWING APPARATUS AND DRAWING METHOD THEREOF

CROSS-REFERENCE TO RELATED APPLICATIONS

The entire disclosure of Japanese Patent Application No. 2013-240691 filed on Nov. 21, 2013 including description, claims, drawings, and abstract are incorporated herein by reference in its entirety.

BACKGROUND OF THE INVENTION

1. Field of the Invention

The present invention relates to a drawing apparatus and a drawing method thereof.

2. Description of Related Art

Conventionally, there are known ink-jet type nail print apparatuses which spray ink from print heads and print nail designs on nails. Such nail print apparatus is described in Japanese Unexamined Patent Application Publication No. 2003-534083, for example.

By using such nail print apparatuses, nail printing can be performed easily at home.

However, in ink-jet type nail print apparatuses, it is difficult to eject, from print heads, ink including color materials which have large particle diameters as used in nail polish on the market, and such like. Thus, there is a problem that printable pictures are limited and the finish is not beautiful.

With respect to this, in a case of plot type print apparatuses which include drawing heads equipped with writing tools such as pens and perform drawing by making tip portions of the writing tools contact sheets (targets) and applying ink with the writing tools, the type of ink which can be used is not limited, and thus, nail printing as applied at nail salons can be performed on nails.

However, in print apparatuses which draw images by plotting with a plurality of inks which have different colors from each other, in a case where a first ink having a first color is applied to a first area to perform drawing and thereafter a second ink having a second color that is different from the first color is applied to a second area contacting with the first area to perform drawing before the first ink becomes dry, a mixed color or such like is sometimes generated due to a mixture of the first ink and the second ink at the border between the first area and the second area, leading to defection of images and running of colors, and thus, the finish is not beautiful.

Especially, when nail printing is performed on nails, more time is required to dry ink compared to drawing on sheets of paper since ink is not absorbed into the nails. Thus, the above defection of images and running of colors due to the color mixture of ink and such like occur easily.

In order to avoid the defection of images and running of colors due to the color mixture of ink and such like, after plotting an ink, the user needs to wait for the ink to be sufficiently dry to plot an ink of another color. In such case, time required for nail printing is increased.

SUMMARY OF THE INVENTION

The present invention has advantages that a drawing apparatus and a drawing method thereof can prevent defection of images and running of colors due to color mixtures and shorten the time required for drawing, the drawing apparatus having a configuration in which images are drawn by drawing plural types of ink on a plurality of areas having a contact part to contact with each other.

According to one aspect of the present invention, there is provided a drawing apparatus, including: a drawing unit which performs drawing of a design by applying inks of plural types to a drawing target area of a drawing target; and a control unit which controls the drawing unit on basis of image data of the design; wherein the control unit sets a plurality of unit areas each of which has a contact part contacting with each other in the drawing target area on basis of the image data, and the control unit controls the drawing unit to perform drawing on a specific unit area of the plurality of the unit areas when the control unit determines that every unit area contacting with the specific unit area in the plurality of the unit areas is at least a dried unit area for which drying of the applied ink is finished or an un-drawn unit area to which the ink is not applied.

According to another aspect of the present invention, there is provided a drawing apparatus, including: a drawing unit which performs drawing of a design by applying inks of plural types to a drawing target area of a drawing target; and a control unit which controls the drawing unit on basis of image data of the design; wherein the control unit sets a plurality of unit areas each of which has a contact part contacting with each other in the drawing target area on basis of the image data, and the control unit controls the drawing unit to perform drawing on a specific unit area of the plurality of the unit areas when the control unit determines that every unit area contacting with the specific unit area in the plurality of the unit areas does not include an un-dried unit area which the ink is applied and drying of the ink is not finished.

According to another aspect of the present invention, there is provided a drawing method of a drawing apparatus which performs drawing of a design by applying inks of plural types to a drawing target area of a drawing target, the method including: setting a plurality of unit areas each of which has a contact part contacting with each other in the drawing target area on basis of image data of the design; and performing drawing on a specific unit area of the plurality of the unit areas with a drawing unit when every unit area contacting with the specific unit area in the plurality of the unit areas is determined to be at least a dried unit area for which drying of the applied ink is finished or an un-drawn unit area to which the ink is not applied.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 7 is a view showing an example of an area number table corresponding to the nail design of FIG. 6;

FIG. 8 is a view showing an example of a drying time table corresponding to the nail design of FIG. 6;

FIG. 9 is a view showing an example of a surroundings relation table corresponding to the nail design of FIG. 6;

FIG. 10 is a view showing an example of a drawing management table corresponding to the nail design of FIG. 6;

FIG. 15 is a view showing an example of an area number table corresponding to the nail design of FIG. 14;

FIG. 16 is a view showing an example of a drying time table corresponding to the nail design of FIG. 14;

FIG. 17 is a view showing an example of a surroundings relation table corresponding to the nail design of FIG. 14;

FIG. 18 is a view showing an example of a drawing management table corresponding to the nail design of FIG. 14;

DETAILED DESCRIPTION OF THE PREFERRED EMBODIMENT

Figure 1:
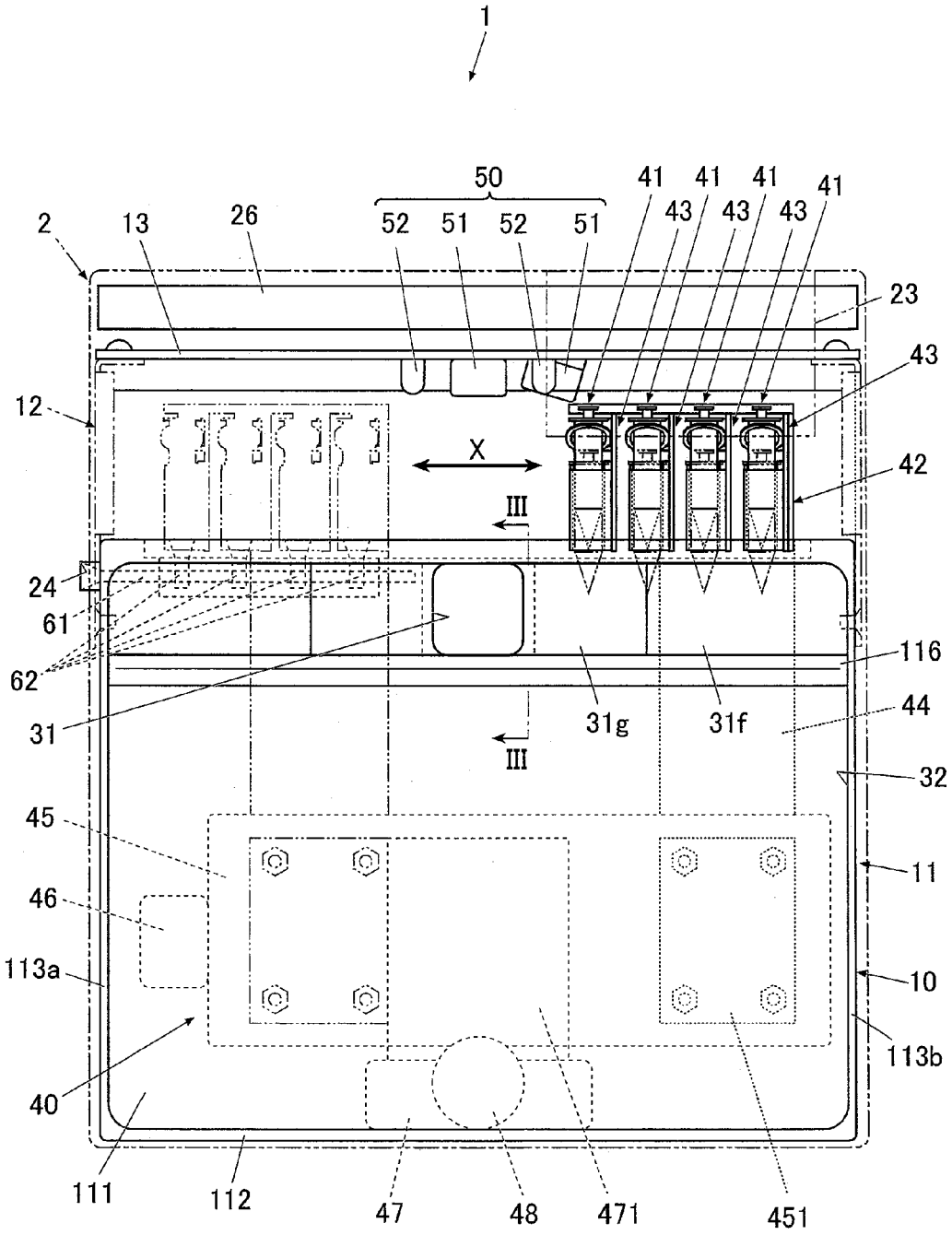
FIG. 1 is a front view of a drawing apparatus in the embodiment.

Hereinafter, an embodiment of a drawing apparatus according to the present invention will be described in detail by showing the drawings.

Though the after-mentioned embodiment is provided with various technically preferred limitations to perform the present invention, the scope of the present invention is not limited to the following embodiment and illustrated examples.

In the following embodiment, the drawing apparatus performs drawing on fingernails of hands as a drawing target. However, the drawing target of the present invention is not limited to the fingernails of hands. The drawing target may be nails of toes.

FIG. 1 is a front view of the drawing apparatus.

Figure 2:
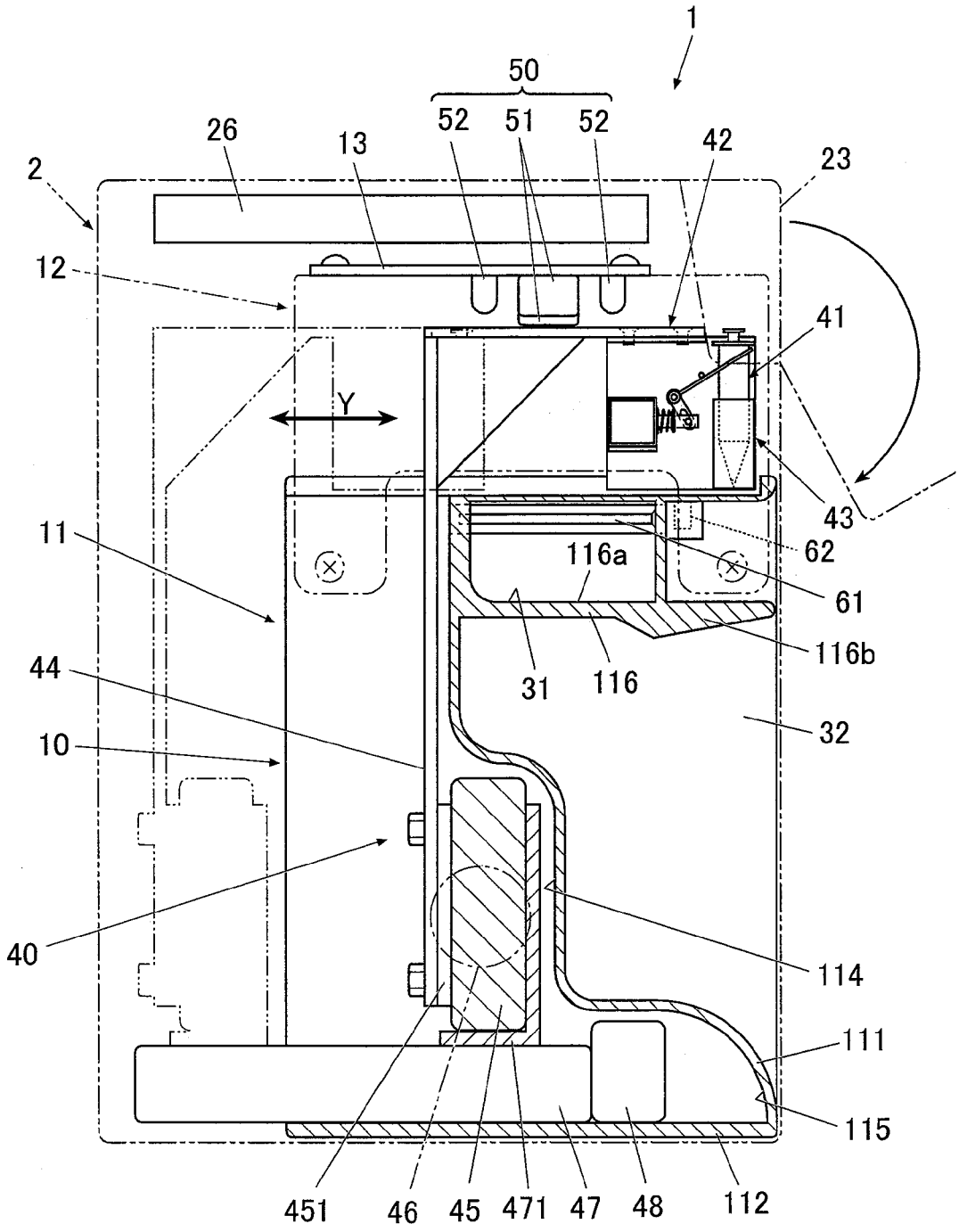
FIG. 2 is a lateral view of cross section of a part of the drawing apparatus shown in FIG. 1, showing an internal configuration thereof.

FIG. 2 is a lateral view of a cross section of a part of the drawing apparatus shown in FIG. 1, showing the internal configuration thereof.

As shown in FIGS. 1 and 2, the drawing apparatus 1 is a nail print apparatus and includes a case main body 2 and an apparatus main body 10 contained in the case main body 2. In FIGS. 1 and 2, the case main body is shown by a two-dot chain line.

A writing tool replacement cover 23 which is configured to be openable and closable for replacing an after-mentioned writing tool 41 such as a pen in a drawing unit 40 is provided at an end of the upper section on the front surface of the case main body 2.

The writing tool replacement cover 23 is rotatable from a closed state to an open state shown in FIG. 2 via a hinge or the like, for example.

At the position on a lateral surface (left lateral surface in FIG. 1 in the embodiment) of the case main body 2 corresponding to an after-mentioned writing tool test writing unit 61, there is provided a medium inserting port 24 through which a medium to perform drawing (not shown in the drawings) to be placed on the writing tool test writing unit 61 can be replaced.

An operation unit 25 (see FIG. 5) is set on the upper surface (top plate) of the case main body 2.

The operation unit 25 is an input unit for performing various input by a user.

The operation unit 25 is provided with a power switch button to turn on the drawing apparatus 1, a stop switch button to stop an operation, a design selection button to select a nail design (design image) to be drawn on a nail T, a drawing switch button to instruct start of drawing and operation buttons for performing various types of input, for example.

A display unit 26 is set at a nearly central portion of the upper surface (top plate) of the case main body 2.

The display unit 26 is configured by including a liquid crystal display (LCD: Liquid Crystal Display), an organic electroluminescent display and other flat display, for example.

In the embodiment, on the display unit 26, a nail image (finger image including an image of a nail T) obtained by photographing a printing finger U1, an image such as the outline of the nail T included in the nail image, a design selection screen for selecting a nail design to be drawn on the nail T, thumbnail images for design confirmation, instruction screens for displaying various instructions are appropriately displayed, for example.

A touch panel may be integrally formed on the surface of the display unit 26. In such case, for example, various types of selection and instruction can be performed by touching the touch panel surface with a fingertip or the like. Various types of input can be carried out also by tools other than fingers, for example, by a touching operation of touching the surface of the display unit 26 with a stylus pen or a writing tool of sharpened stick.

The apparatus main body 10 are formed in a nearly box shape and includes a lower machine casing 11 which is set at the lower section in the case main body 2 and an upper machine casing 12 which is set above the lower machine casing 11 and at the upper section in the case main body 2.

First, the lower machine casing 11 will be described.

The lower machine casing 11 includes a back surface board 111, a bottom board 112, a horizontal pair of side boards 113*a* and 113*b*, an X-direction movement stage containing unit 114, a Y-direction movement stage containing unit 115 and a dividing wall 116.

The lower ends of the side boards 113*a* and 113*b* are connected to the left and right end portions of the bottom board 112, respectively, and the side boards 113*a* and 113*b* are vertically provided with respect to the bottom board 112.

As shown in FIG. 2, the lower portion of the back surface board 111 is formed to be concave in two steps toward the front side (front side in the finger inserting direction). The lower end portion of the back surface board 111 is connected to the front end portion of the bottom board 112, and the back surface board 111 divides an area, which is surrounded by the bottom board 112 and the side boards 113*a* and 113*b*, back and forth.

The X-direction movement stage containing unit 114 and the Y-direction movement stage containing unit 115 are formed back from the concave back surface board 111 (see FIG. 2). In the X-direction movement stage containing unit 114, an X-direction movement stage 45 of the drawing unit 40 is contained when the drawing unit 40 (FIG. 6) is moved forward (toward the front side of the finger inserting direction).

A Y-direction movement stage 47 of the drawing unit 40 is disposed in the Y-direction movement stage containing unit 115.

The dividing wall 116 is provided inside the lower machine casing 11 so as to vertically divide a space (space at the front side of the finger inserting direction which is surrounded by the back surface board 111, bottom board 112 and the side boards 113*a* and 113*b*) at the front side inside the lower machine casing 11. The dividing wall 116 is provided to be nearly horizontal, the lateral end portions of the dividing wall 116 are connected to the side boards 113*a* and 113*b*, respectively, and the rear end portion of the dividing wall 116 is connected to the back surface board 111.

A finger fixing unit 30 is integrally provided in the lower machine casing 11.

Figure 3:
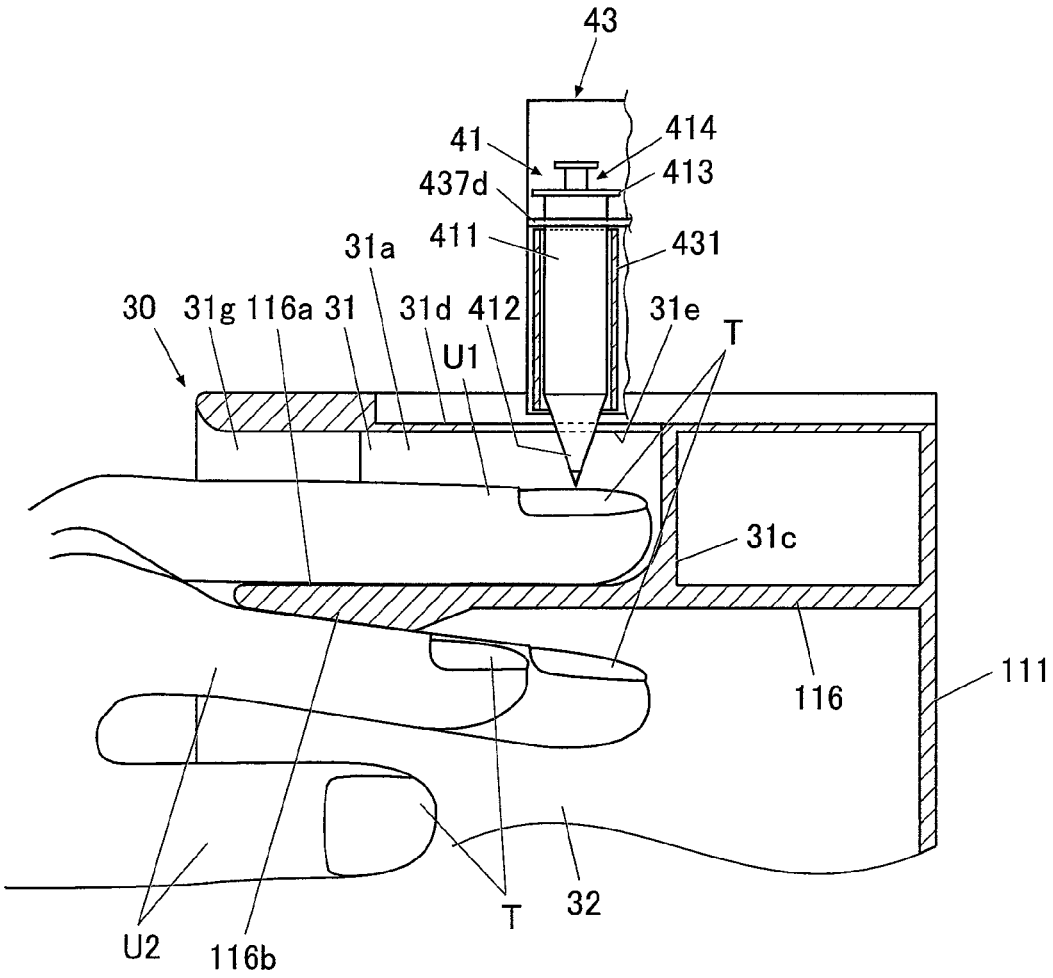
FIG. 3 is a sectional view of FIG. 1 cut along the line III-III.

With reference to FIG. 3, the finger fixing unit 30 will be described.

FIG. 3 is a sectional view showing a cross-section cut along the line shown in FIG. 1 and seen from the arrow direction.

The finger fixing unit 30 is configured by including a finger receiving unit 31 which receives a finger (hereinafter, called "printing finger U1") corresponding to a nail T which is a drawing target and a finger resting unit 32 in which fingers (hereinafter, called "non-printing fingers U2") other than the printing finger U1 rests.

The finger receiving unit 31 is disposed at a nearly central position in the width direction of the lower machine casing 11 at the upper side of the dividing wall 116.

The space divided by the dividing wall 116 to be lower side of the lower machine casing 11 forms the finger resting unit 32.

For example, in a case where drawing is to be performed on a nail T of a ring finger, as shown in FIG. 3, the ring finger as the printing finger U2 is inserted into the finger receiving unit 31 and the other four fingers (thumb, index finger, middle finger and little finger) which are non-printing fingers U2 are inserted into the finger resting unit 32.

The finger receiving unit 31 is open at the front surface side (front side in the printing finger insertion direction) of the lower machine casing 11, and defined by a finger placement unit 116*a* forming a part of the dividing wall 116 at the lower side, by dividers 31*a* and 31*b* at both lateral sides and by a divider 31*c* at the back side. The finger placement unit 116*a* is for placing the finger (printing finger U1) of the nail T to perform drawing on the X-Y plane.

The upper side of the finger receiving unit 31 is defined by a roof 31*d*.

A window 31*e* for exposing the nail T of the printing finger U1 inserted into the finger receiving unit 31 is formed in the roof 31*d*.

A front wall 31*f* (see FIG. 1) which covers the front surface side of the lower machine casing 11 is vertically provided at each of the lateral portions of the front surface side of the lower machine casing 11 on the upper surface of the dividing wall 116.

On the upper surface of the dividing wall 116, a pair of guide walls 31*g* is vertically provided, the guide walls 31*g* being narrowing toward the finger receiving unit 31 from the end portions of the front walls 31*f* which are near the central portion and guiding the printing finger U1 into the finger receiving unit 31.

The user can sandwich the dividing wall 116 between the printing finger U1 inserted into the finger receiving unit 31 and the non-printing fingers U2 inserted into the finger resting) unit 32. Thus, the printing finger U1 inserted into the finger receiving unit 31 is fixed stably.

In the embodiment, a protrusion 116*b* protruding downward is formed at the front end portion of the dividing wall 116. The protrusion 116*b* may be a tapered unit which gradually becomes thinner toward the front side and gradually becomes thicker toward the back side. Alternatively, the entire protrusion 116*b* may be thick with respect to the concave at the back side of the dividing wall 116. By forming the protrusion 116*b* at the front end portion of the dividing wall 116, when the non-printing fingers U2 are inserted into the finger resting unit 32, a space is secured between the nails T of the fingers on which drawing is already performed and the dividing wall 116. Thus, it is possible to prevent ink from attaching to the apparatus due to the contact of the nails T with the lower surface of the dividing wall 116 and prevent pictures drawn on the nail T from blurring to be damaged.

Next to the finger receiving unit 31 (the position corresponding to the medium inserting port 24 of the case main body 2, and the left side in FIG. 1 in the embodiment) on the upper surface of the dividing wall 116, the writing tool test writing unit 61 for after-mentioned test writing of a pen 41 is provided within a range enabling drawing of an after-mentioned drawing head 42. It is preferable that the writing tool test writing unit 61 is provided so as to be nearly as high as the nail T when the printing finger U1 is inserted into the finger receiving unit 31.

The writing tool test writing unit 61 is a flat plate portion for placing a drawing medium (not shown in the drawings) inserted through the medium inserting port 24 of the case main body 2.

The drawing medium to be placed on the writing tool test writing unit 61 may be anything as long as it can condition a pen tip 412, and is a single sheet of paper, for example.

The writing tool test writing unit 61 is for improving the condition of the pen tip 412 by lowering the writing tool 41 onto the drawing medium and drawing a predetermined image such as "o" and "∞" to perform test writing before starting the drawing based on image data on the nail T in order to prevent the blur of ink at the start of drawing due to a dry pen tip 412, poor ink application and such like.

Though the predetermined image to be drawn at test writing is not especially limited, a preferable one is a simple figure such as "o" and "∞" so as not to waste too much ink.

It is preferable to draw the figure such as "o" and "∞" by gradually shifting the position within the range of the writing tool test writing unit 61 every time the test writing is performed.

When the test writing is performed on the nearly entire surface of the drawing medium with no drawing space left, a display screen such as "replace sheet" which requires replacement of the drawing medium is displayed on the display unit 26. In such case, by the user removing the drawing medium from the medium inserting port 24 to replace it with a new one, test writing becomes possible on the new drawing medium.

In a case where the drawing medium is a roll of paper, when there is no drawing space left, the roll of paper is wheeled to feed a drawing medium and test writing becomes possible on a new drawing surface.

In the embodiment, writing tool caps (drawing tool caps) 62 made of rubber are set in front (front side of the finger inserting direction) of the writing tool test writing unit 61.

The number of the provided writing tool caps 62 (four in the embodiment) corresponds to the writing tools 41 set in the drawing unit 40. After setting the writing tools 41 in the drawing unit 40 and when drawing is not performed (non-drawing time), the pen tips 412 of the drawing tools 41 are contained in the drawing tool caps 62.

The region where the writing tool caps 62 and such like are disposed is the home space (standby position) where the writing tools 41 standby at the non-drawing time.

That is, at the non-drawing time, the writing tools 41 are moved toward directly above the writing tool caps 62, and thereafter the writing tools 41 are lowered by after-mentioned solenoids 440 (see FIG. 4), and the pen tips 412 are contained in the writing tool caps 62. Thereby, the pen tips 412 can be prevented from drying during the non-drawing time. The shapes and such like of the writing tool caps 62 are not limited to the illustrated example. For example, the writing tool caps 62 may be a long groove-like pen cap which can receive the pen tips 412 of all the writing tools 41 set in the drawing unit 40.

In the embodiment, since the writing tool caps 62 are provided near the writing tool test writing unit 61 in such way, drawing can be started by elevating a writing tool 41 to perform test writing in the writing tool test writing unit 61 which is close to the writing tool caps 62. Thus, it is possible to minimize the time required for moving the writing tool 41 and such like and perform the drawing operation rapidly.

The drawing unit 40 performs drawing on nails on the basis of image data of a nail design by using a plurality of types of ink which are different from each other.

The drawing unit 40 is configured by including the drawing head 42 which includes a plurality of writing tools (drawing tools) 41, a unit supporting member 44 which supports the drawing head 42, the X-direction movement stage 45 for moving the drawing head 42 in the X direction (X direction in FIG. 1, lateral direction of the drawing apparatus 1), an X-direction movement motor 46, the Y-direction movement stage 47 for moving the drawing head 42 in the Y direction (Y direction in FIG. 2, front-back direction of the drawing apparatus 1), a Y-direction movement motor 48 and such like.

In the embodiment, the drawing head 42 includes four writing tool carriages (drawing tool carriages) 43 each of which holds a single writing tool 41.

The writing tool 41 performs drawing by applying ink to the surface of the nail T.

Figure 4B:
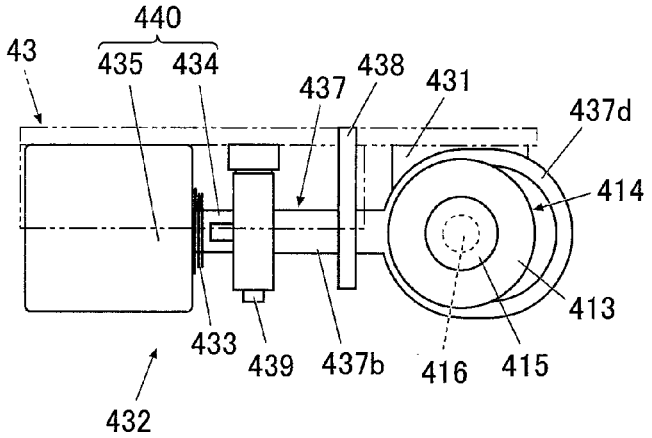
FIG. 4B is an enlarged view of the writing tool carriage and the writing tool supported by the writing tool carriage in the drawing state, showing a top view of the writing tool carriage and the writing tool of FIG. 4A seen from the direction of arrow b.
Figure 4A:
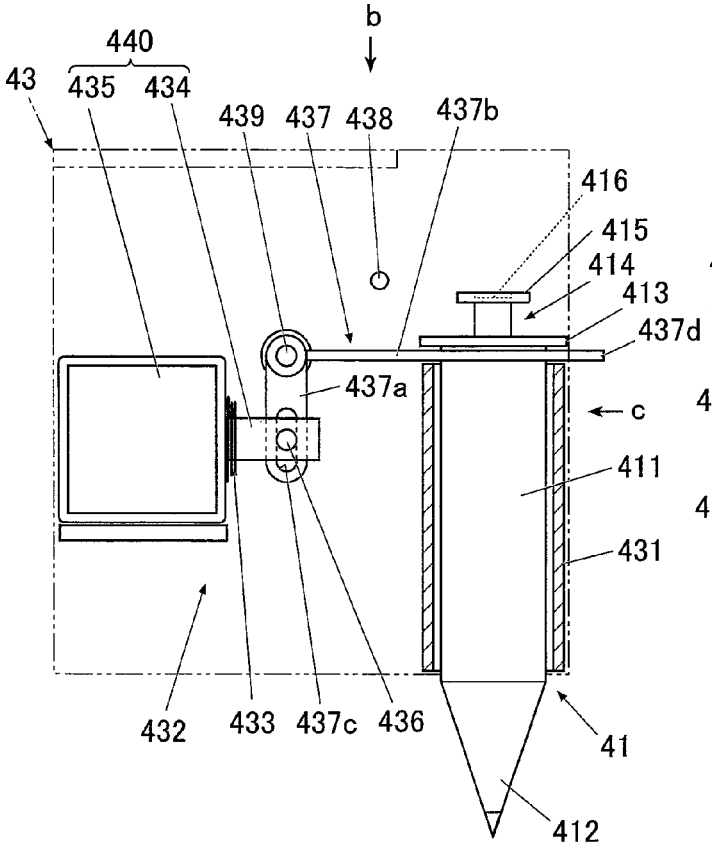
FIG. 4A is an enlarged view of a writing tool carriage and a writing tool supported by the writing tool carriage in a drawing state, showing a lateral view of the writing tool carriage and the writing tool.
Figure 4C:
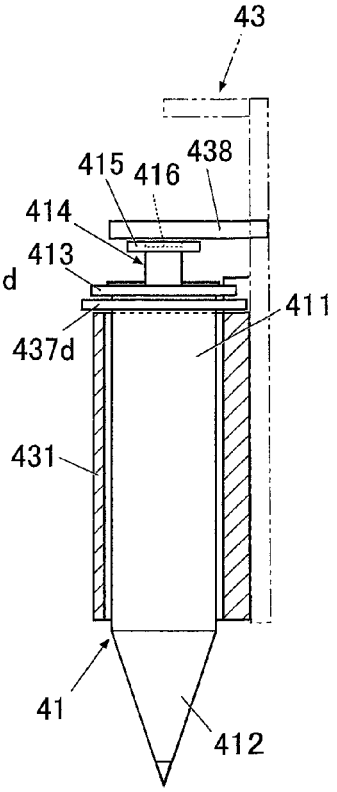
FIG. 4C is an enlarged view of the writing tool carriage and the writing tool supported by the writing tool carriage in the drawing state, showing a front view of the writing tool carriage and the writing tool of FIG. 4A, seen from the direction of arrow c.

FIGS. 4A to 4C are enlarged views of the writing tool carriage 43 and the writing tool 41 held thereby, showing a state (drawing state) in which drawing is performed.

FIG. 4A is a lateral view of the writing tool carriage 43 and the writing tool 41.

FIG. 4B is a top view of the writing tool carriage 43 and the writing tool 41 of FIG. 4A, seen from the direction of arrow b.

FIG. 4C is a front view of the writing tool carriage 43 and the writing tool 41 of FIG. 4A, seen from the direction of arrow c.

As shown in FIGS. 4A to 4C, each of the writing tools 41 held by the writing tool carriages 43 is provided with the pen tip 412 at the one end of a pen shaft 411.

The inside of the pen shaft 411 is an ink containing unit which contains various ink.

The ink to be contained inside the pen shaft 411 is not especially limited in viscosity and particle diameter (size of particle) of a color material and such like, and various types of ink can be used.

As the ink, ink including gold and silver lame, white ink, ultraviolet curable ink, and ink for gel nail, undercoat, topcoat and manicure can also be used, for example.

At the other end of the pen shaft 411, a cover unit 414 including a flange portion 413 which extends outside the pen shaft 411 is attached.

Materials forming the pen shaft 411 and the cover unit 414 are not especially limited. However, the preferable material forming the pen shaft 411 and the cover unit 414 is resin and such like for mass production of the writing tool 41.

In the embodiment, a finger grip unit 415 is provided at the upper portion of the cover unit 414 so as to be easily pinched by a hand, a pair of tweezers and such like. A small iron piece 416 is further provided to the finger grip unit 415 by embedding, attachment and such like so as to be absorbed to a magnet.

The writing tool 41 draws a picture by the pen tip 412 being pressed against the surface of the nail T and the ink contained in the pen shaft 411 being ejected, and the pen tip 412 of the writing tool 41 is a ballpoint pen type.

The writing tool 41 is not limited to the ballpoint pen type. The writing tool 41 may be a felt pen type which performs drawing with ink sinking through the pen tip made of felt or a calligraphy pen type which performs drawing with ink sinking through a tied brush, for example.

Pen tips 412 with various types of thickness and shape can be used.

The plurality of writing tools 41 to be held by the writing tool carriages 43 may have the pen tips 412 of a same type or may have different types of pen tips 412.

Each of the writing tools 41 is merely inserted into a writing tool holding unit 437*d* and a writing tool holder 431 of a writing tool carriage 43 from above to be held as described later. Thus, the writing tool 41 can be replaced easily by a method such as pinching the finger grip unit 415 with a hand or a pair of tweezers or by approaching a stick member (not shown in the drawings) which has a magnet attached at the tip thereof toward the hand grip unit 415 to absorb and raise the iron piece 416 to the magnet after opening the writing tool replacement cover 23 provided at the case main body 2, for example.

Thus, the user can appropriately replace the writing tools 41 set in the writing tool carriages 43 with writing tools 41 having different types of pen tips 412 or ink according to the nail design to be drawn. Thus, the user can achieve a wide range of nail designs.

In the embodiment, four writing tool carriages 43 holding the writing tools 41 are aligned in the width direction (lateral direction, X-direction in FIG. 1) of the apparatus. Thus, the positions of the pen tips 412 are shifted from each other in the X-direction (lateral direction of the apparatus). The amount of shift is an integral multiple of one step in the drawing operation, and the drawing is performed by correcting the position in X direction of the writing tool 41 for the number of steps corresponding to the amount of the shift according to each of the writing tools 41 used for the drawing. Thus, the four writing tools 41 can perform drawing at the same position.

Each of the pen carriages 43 is provided with the writing tool holder 431 which nearly vertically holds the writing tool 41 and a writing tool lifting mechanism 432 for moving the writing tool 41 up and down.

The writing tool holder 431 is a tube to insert the pen tip 412 and the pen shaft 411 and holds the writing tool 41.

The writing tool lifting mechanism 432 includes a solenoid 440 configured by including a plunger 434 and a coil unit 435, a pin 436 which is attached to the moving end side of the plunger 434 of the solenoid 440, a writing tool lifting lever 437 which is joined to the plunger 434 via the pin 436 and a stopper 438 which suppresses too much elevation of the writing tool lifting lever 437.

The solenoid 440 has a mechanism in which movable plunger 434 performs reciprocating motion like a piston in the coil unit 435 wound by copper wire or the like.

The plunger 434 is forced forward (right direction in FIGS. 2 and 4A) by the spring 433, and the solenoid 440 is a pull type solenoid which absorbs the plunger 434 backward (left direction in FIGS. 2 and 4A) against the biasing force of the spring 433. The solenoid 440 is not limited to the pull type and may be configured to be a push type.

As shown in FIG. 4A, the writing tool lifting lever 437 is an L-shaped member in which a shorter arm 437*a* is nearly perpendicular to a longer arm 437*b*. A long hole 437*c* to be locked to the pin 436 is formed at the end portion of the shorter arm 437*a*.

The writing tool holding unit 437*d* to insert the writing tool 41 is provided at the end portion of the longer arm 437*b*.

The writing tool holding unit 437*d* is formed in a ring shape having an inner diameter which is larger than the diameters of the pen shaft 411 and the pen tip 412 of the writing tool 41 and smaller than the diameter of flange portion 413 of the writing tool 41. The pen shaft 411 and the pen tip 412 are inserted through the writing tool holding unit 437*d*, which locks the flange portion 413 so as to support it from below.

A rotation shaft 439 is inserted through the intersection of the shorter arm 437*a* and the longer arm 437*b* in the writing tool lifting lever 437 from the writing tool carriage 43 side.

In the embodiment, when the solenoid 440 is being driven, as shown in FIG. 4A, the plunger 434 is pulled back against the elastic force of the spring 433, and the writing tool lifting lever 437 locked to the pin 436 of the plunger 434 is held at a position where the longer arm 437*b* is nearly horizontal.

In this state, the pen tip of the writing tool 41 is lowered to be lower than the writing tool holder 431 of the writing tool carriage 43 so as to be contactable to the surface of the nail T and the drawing medium 61*a*, which is a drawing state.

On the other hand, in a state in which the solenoid 440 is released, the plunger 434 protrudes forward by the elastic force of the spring 433. At this time, the writing tool lifting lever 437 locked to the pin 436 of the plunger 434 is rotated upward (counterclockwise direction) around the rotation shaft 439 as a supporting point, and the longer arm 437*b* contacts the stopper 438 to be stopped.

Thus, the flange portion 413 of the pen 41 is flipped up by the writing tool lifting lever 437 (see FIG. 2). In this state, the pen tip of the writing tool 41 is lifted upper than the writing tool holder 431 of the writing tool carriage 43 and does not contact with the surface of the nail T and the drawing medium, which is a non-drawing state.

In such way, the force moving the plunger 434 forward and backward by the solenoid 440 is converted into a force moving the writing tool 41 upward and downward by the rotation shaft 439 and the writing tool lifting lever 437 which is rotated around the rotation shaft 439 as the supporting point.

The writing tool 41 is merely inserted into the writing tool holder 431 of the writing tool carriage 43 to be held and not fixed to the writing tool lifting lever 437 and such like. Thus, the writing tool 41 is forced downward by its own weight.

Thus, the writing tool 41 can move down freely along the writing tool holder 431 to the position where the flange portion 413 contacts the upper surface of the writing tool holding unit 437*d*. When contacting the nail T surface or the drawing medium, the pen tip 412 is pressed against the nail T surface and the drawing medium.

That is, in a case where drawing is performed with the writing tool 41 on the nail T, the pen tip 412 is configured to be able to freely move in the Z direction (that is, upward and downward) orthogonal to the X-Y plane on which the printing finger U1 is placed in accordance with the surface shape (unevenness of the surface and such like) of the nail T (in accordance with the curved surface or height of the nail T).

For example, when drawing is performed on a lower portion (such as both end portions in the width direction of the nail T) of the nail T, the writing tool 41 is lowered near the position where the flange portion 413 contacts the upper surface of the writing tool holding unit 437*d*. When drawing is performed on a higher portion of the nail T (such as a central portion in the width direction of the nail T), the writing tool 41 is lifted in accordance with the height of the nail T and the flange portion 413 is moved away from the upper surface of the writing tool holding unit 437*d*.

The writing tool 41 is relatively light that the weight thereof is several grams to several tens of grams. Thus, the user does not feel pain when the pen tip 412 contacts the nail T. Since the writing pressure of the writing tool 41 is secured by its own weight, the user can draw a nail design on the nail T and such like.

In the embodiment, among the members forming the writing tool lifting mechanism 432, the rotation shaft 436 and the stopper 438 are formed of metal such as stainless steel, and the other members are formed of materials such as resin which are light and do not react to a magnet. The materials of the members forming the writing tool lifting mechanism 432 are not limited to the examples illustrated here.

In the embodiment, the solenoid 440 is used as an actuator for moving the writing tool 41 up and down. However, the actuator for moving the writing tool 41 up and down is not limited to the solenoid 440. Since the writing tool 41 is light, the actuator for moving the writing tool 41 up and down can be formed by various types of compact driving devices as well as the solenoid.

The unit supporting member 44 which supports the drawing head 42 is fixed to the X-direction movement unit 451 which is attached to the X-direction movement stage 45.

The X-direction movement unit 451 is moved in the X-direction along the guide which is not shown in the drawings on the X-direction movement stage 45 by the drive of the X-direction movement motor 46. Thus, the drawing head 42 is moved in the X-direction (X-direction in FIG. 1, lateral direction of the drawing apparatus 1).

The X-direction movement stage 45 is fixed to the Y-direction movement unit 471 of the Y-direction movement stage 47.

The Y-direction movement unit 471 is moved in the Y-direction along the guide which is not shown in the drawings on the Y-direction movement stage 47 by the drive of the Y-direction movement motor 48. Thus, the drawing head 42 is moved in the Y-direction (Y-direction in FIG. 2, front-back direction of the drawing apparatus 1).

In the embodiment, the X-direction movement stage 45 and the Y-direction movement stage 47 are formed by combining the X-direction movement motor 46 and the Y-direction movement motor 48, and ball screws and guides which are not shown in the drawings.

As the X-direction movement motor 46 and the Y-direction movement motor 48 in the embodiment, a stepping motor which moves for a predetermined amount every time a single pulse is transmitted is applied.

In the embodiment, a head driving unit 49 (see FIG. 5) which drives the drawing head 42 including the writing tools 41 that perform drawing on the nail T in X-direction and Y-direction is formed by the X-direction movement motor 46, the Y-direction movement motor 48 and such like.

The solenoids 440, the X-direction movement motor 46 and the Y-direction movement motor 48 in the drawing unit 40 for moving the writing tools 41 up and down are connected to a drawing control unit 815 (see FIG. 5) of an after-mentioned control device 80 and controlled by the drawing control unit 815.

As shown in FIGS. 1 and 2, a photographing unit 50 is provided on the upper machine casing 12.

That is, a substrate 13 is set on the upper machine casing 12, and two cameras 51 as a photographing device are set at the central portion of the lower surface of the substrate 13.

It is preferable that each of the cameras 51 has approximately two million pixels or more, for example.

Each of the cameras 51 photographs the nail T of the printing finger U1 inserted into the finger inserting unit 31 and obtains a nail image (finger image including nail T) which is an image of nail T of the printing finger U1.

In the embodiment, the two cameras 51 are provided so as to be nearly parallel to each other in the width direction of the nail T of the printing finger U1 inserted into the printing finger receiving unit 31.

Among the two cameras 51, one camera 51 is provided so as to face to the bottom surface of the finger receiving unit 31 and photograph the nail T from above.

The other camera 51 is provided so as to be slightly inclined with respect to the bottom surface of the finger receiving unit 31 and photograph the nail T obliquely from above.

On the substrate 13, lights (lighting device) 52 such as white LEDs are set so as to surround the cameras 51. The lights 52 illuminate the nail T of the printing finger U1 at photographing by the cameras 51.

The photographing unit 50 is configured by including the cameras 51 and the lights 52.

The photographing unit 50 is connected to a photographing control unit 811 (see FIG. 5) in the after-mentioned control device 80 and controlled by the photographing control unit 811.

Image data of the image obtained by the photographing unit 50 is stored in a nail image storage area 821 of an after-mentioned storage unit 82.

In the embodiment, the nail T is photographed from at least two different positions or angles by the two cameras 51 as the photographing device, and at least two nail images are obtained.

Then, on the basis of the plurality of nail images, an after-mentioned nail information detecting unit 512 can detect nail information such as the inclination angle (hereinafter, called "inclination angle of nail T" or "nail curvature") with respect to the X-Y plane of the nail T surface and a vertical position of nail T in addition to the outline (shape of nail T) of nail T.

That is, for example, by obtaining the image of nail T from above and the image of nail T obliquely from above, accurate detection can be performed for the position and inclination angle of nail T surface in addition to the outline of nail T.

The configuration including two cameras 51 as the photographing device so as to be able to detect the inclination angle or nail curvature of nail T is not an essential configuration, and the nail T may be photographed only from above to detect the outline of nail T (shape of nail T) as nail information.

The control device 80 is set on the substrate 13 or such like disposed on the upper machine casing 12, for example.

Figure 5:
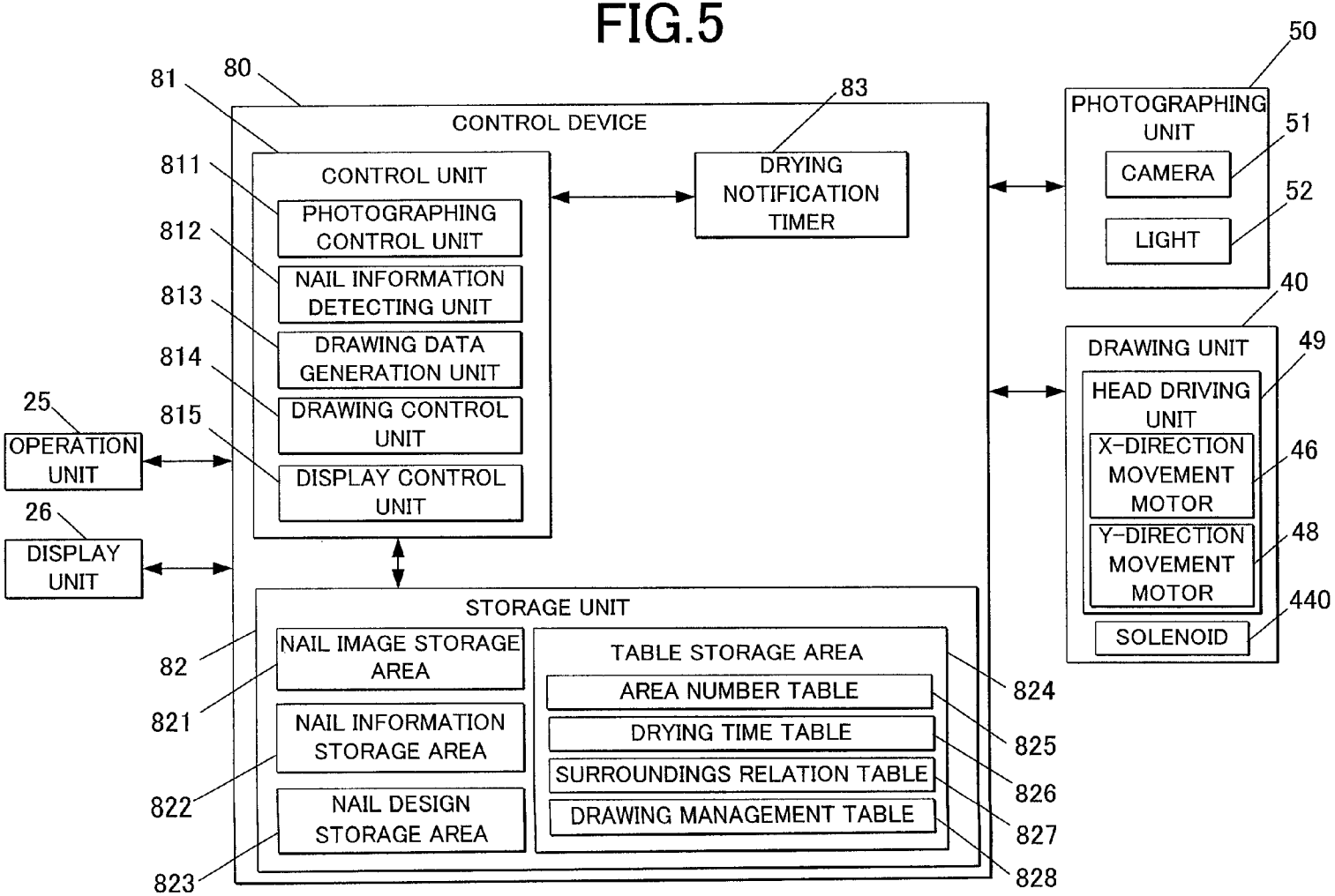
FIG. 5 is a main part block diagram showing the control structure of the drawing apparatus according to the embodiment.

FIG. 5 is a main part block diagram showing a control structure in the embodiment.

As shown in FIG. 5, the control device 80 is a computer which includes a control unit 81 having a CPU (Central Processing Unit) and the storage unit 82 having a ROM (Read only memory), a RAM (Random access memory) and such like which are not shown in the drawings.

Various programs for operating the drawing apparatus 1 and various data are stored in the storage unit 82.

Specifically, in the ROM of the storage unit 82, various programs such as a nail information detecting program for detecting nail information such as the shape of the nail T from the nail image, a drawing data generation program for generating drawing data for performing drawing on the nail T on the basis of image data of a nail design, and a drawing program for performing drawing processing are stored. The control device 80 executes the programs to integrally control the units of the drawing apparatus 1.

In the embodiment, the storage unit 82 is provided with a nail image storage area 821 for storing a nail image of the nail T of the printing finger U1 of the user obtained by the photographing unit 50, a nail information storage area 822 for storing the nail information detected by the nail information detecting unit 812, a nail design storage area 823 for storing image data of nail designs to be drawn on the nail T and a table storage area 824 for storing various data tables.

Figure 6:
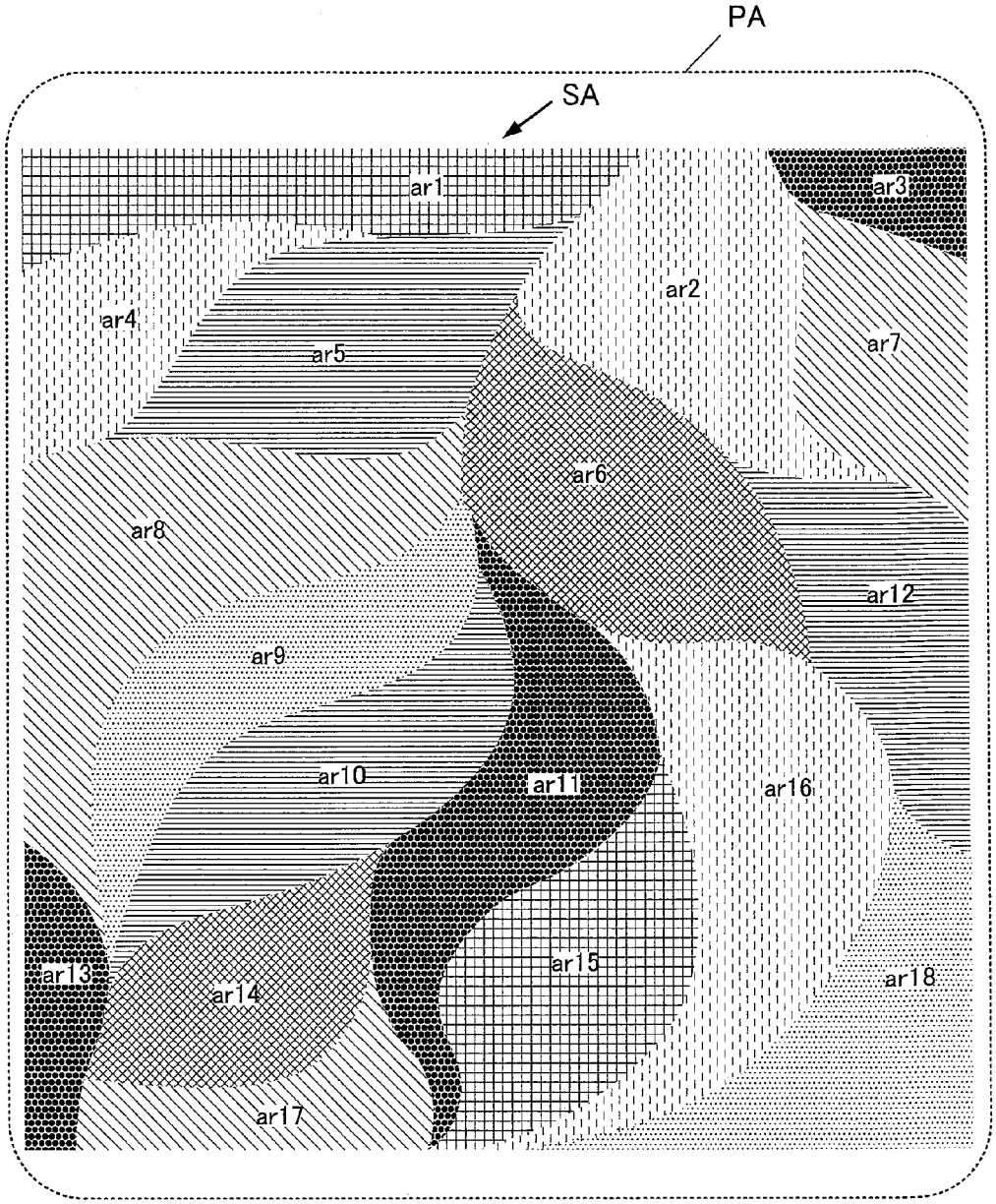
FIG. 6 is a view showing an example of a nail design drawn by the drawing apparatus according to the embodiment.

FIG. 6 is a view showing an example of nail design to be drawn by the drawing apparatus 1 in the embodiment.

In the embodiment, the area on which the nail design is drawn by the drawing unit 40 on the surface of the nail T (drawing target) of the printing finger U1 is called a drawing target area PA.

Then, at least a part of the drawing target area PA is set to be a segmented area SA which is divided into a plurality of unit areas ar on the basis of the nail design.

Here, each of the plurality of unit areas ar of the segmented area SA is an area to be drawn by ink of a single type having a single color. Then, a unit area ar is configured to have contact part contacting with one or a plurality of unit areas ar.

Here, the unit areas ar are provided with respective area numbers (hereinafter, called "area No."). The area numbers are set on the basis of image data of a nail design.

FIG. 6 illustrates an example in which the segmented area SA is divided into 18 unit areas ar (that is, ar1 to ar18 in FIG. 6).

In the example illustrated by FIG. 6, the unit areas an and ar15, the unit areas ar2, ar4 and ar16, the unit areas ar3, ar11 and ar13, the unit areas ar5, ar10 and ar12, the unit areas ar6 and ar14, the unit areas ar7, ar8 and ar17, and the unit areas ar9 and ar18 are drawn by same type ink having same color, respectively.

As described above, even the areas to be drawn by the same type of ink are divided as different unit areas ar when they are separated from each other.

Then, the unit areas ar1 and ar15 are drawn by a first type ink having a first color. The unit areas ar2, ar4 and ar16 are drawn by a second type ink having a second color. The unit areas ar3, ar11 and ar13 are drawn by a third type ink having a third color. The unit areas ar5, ar10 and ar12 are drawn by a forth type ink having a forth color. The unit areas ar6 and ar14 are drawn by a fifth type ink having a fifth color. The unit areas ar7, ar8 and ar17 are drawn by a sixth type ink having a sixth color. The unit areas ar9 and ar18 are drawn by a seventh type ink having a seventh color. The first color, the second color, the third color, the forth color, the fifth color, the sixth color and the seventh color are different from each other.

The image data of nail design to be drawn on the nail T has information for each of the unit areas ar regarding a drying time required for drying the ink applied to the unit area ar.

In the embodiment, the area number table 825, drying time table 826, surroundings relation table 827 and drawing management table 828 are stored in the table storage area 824.

FIG. 7 is a view showing an example of the area number table 825 when drawing is performed on the basis of drawing data corresponding to the nail design of FIG. 6.

FIG. 8 is a view showing an example of a drying time table 826 when drawing is performed on the basis of drawing data corresponding to the nail design of FIG. 6.

FIG. 9 is a view showing an example of a surroundings relation table 827 when drawing is performed on the basis of drawing data corresponding to the nail design of FIG. 6.

FIG. 10 is a view showing an example of a drawing management table 828 when drawing is performed on the basis of drawing data corresponding to the nail design of FIG. 6.

As shown in FIG. 7, the area number table 825 is a table for associating an area number of each of the unit areas ar with drawing data of an image to be drawn on the unit area ar of each area number, the table being generated on the basis of image data of nail design.

Here, as an example, the area number of each of the unit areas ar is stored in a storage area different from the storage area storing image data of the image to be drawn in the unit areas ar (in the embodiment, image data for each of the 18 unit areas ar of the nail design stored in the nail design storage area 823). However, for example, the area number may be arranged at the head or the end of the image data for each unit area ar.

In the embodiment, in a case where drawing control processing is performed by the after-mentioned drawing control unit 814, the drawing control unit 814 confirms whether to perform drawing on each of the unit areas ar in order from the smallest area number (that is, the order from area Nos. 1 to 18, in an example shown in FIG. 6)

As shown in FIG. 8, the drying time table 826 is a table for associating the area number for each of the unit areas ar with a drying time which is set to be required for drying ink applied to the unit area ar. The table is generated on the basis of the image data of nail design.

For example, in FIG. 8, the drying time is set to ten seconds for the unit area ar of area No. 1 (unit area ar1) and the unit area ar of area No. 15 (unit area ar15) on which drawing is performed with the same type ink.

The drying time is set to nine seconds for the unit area ar of area No. 9 (unit area ar9 ) and the unit area ar of area No. 18 (unit area ar18) on which drawing is performed with same type ink.

Inks are different in easiness of dry depending on their composition, viscosity and such like. Thus, the drying time for each of the unit areas ar is set in consideration of the difference in ease of dry depending on the type (color) of ink applied to the unit area ar, and such like.

As shown in FIG. 9, the surroundings relation table 827 is a table for relating unit areas ar contacting with each of the unit areas ar, the table being generated on the basis of the image data of nail design.

In FIG. 9, the unit areas ar of area Nos. 1 to 18 are set to each of the longitudinal and horizontal axes. With respect to each of the area numbers of the longitudinal axis, a circle mark indicating that areas are contacting with each other is set at a column in the horizontal axis for area numbers of unit areas ar which are contacting with the unit area ar.

For example, in a case where drawing is performed on the basis of image data corresponding to the nail design shown in FIG. 6, unit areas ar of area Nos. 2, 4 and 5 are contacting with the unit area ar of area No. 1 (unit area ar1 in FIG. 6). Thus, in the surroundings relation table 827 in FIG. 9, the circle mark indicating areas contacting with each other is set at the columns of area Nos. 2, 4 and 5 in the horizontal row of area No. 1.

As shown in FIG. 10, the drawing management table 828 is a table relating a drawing end flag indicating a drawing end status and a drawing enable flag indicating a drawing enable/unable status to a unit area ar of each of the area numbers.

Here, the drawing end flag is set to be 0 when drawing is not ended and set to 1 when the drawing is ended.

The drawing enable flag is set to 0 when drawing is possible and set to a value other than 0 when drawing is not possible.

That is, as for a unit area ar in an initial state in which drawing is not ended, the drawing end flag indicating the drawing end status is set to 0, and the drawing end flag indicating the drawing end status is set to 1 when the drawing is ended.

The drawing enable flag is set to 0 for a unit area ar in an initial state in which drawing is possible.

Then, when drawing is started for a unit area ar contacting with the unit area ar, the value of the drawing enable flag is incremented to perform addition of "+1".

The value of drawing enable flag changes depending on the drawing status around the unit area ar. On a unit area ar which contact with the unit area ar and on which drawing is already performed, when a period of time required for drying the ink drawn on the unit area ar has elapsed, subtraction of "−1" is performed for the unit area ar.

Then, only when the value of the drawing enable flag is 0, the drawing on the unit area ar is allowed.

For example, with respect to the unit area ar of area No. 2 (unit area ar2 in FIG. 6), unit areas ar1, 3, 5, 6, 7 and 12 are contacting with the unit area ar2. Among the areas, in a case where drawing was already performed and time required for drying ink has not elapsed in the unit areas ar1 and ar3, the drawing enable flag of the unit area ar2 is set to 2. Then, when the time required for drying the ink drawn in the unit area ar1 has elapsed, for example, the value of drawing enable flag for the unit area ar2 of area No. 2 is subtracted by "−1" to be 1. Further, when the time required for drying the ink drawn in the unit area ar3 has elapsed, the value of drawing enable flag for the unit area ar2 of area No. 2 is subtracted by "−1" to be 0. At this time, the drawing on the unit area ar2 is allowed.

In a functional view, the control unit 81 includes the photographing control unit 811, the nail information detecting unit 812, the drawing data generation unit 813, the drawing control unit 814, the display control unit 815 and such like.

The functions as the photographing control unit 811, the nail information detecting unit 812, the drawing data generation unit 813, the drawing control unit 814, the display control unit 815 and such like are achieved in cooperation between the CPU of the control unit 81 and the programs stored in the ROM of the storage unit 82.

In the embodiment, a drying notification timer 83 is connected to the control unit 81.

The drying notification timer 83 counts an elapsed time from the end of drawing after the drawing on each of the unit areas ar is ended. That is, when drawing in each of the unit areas ar is ended, a setting value of drying time for an area number corresponding to the unit area ar (drying time necessary for drying ink prescribed in the drying time table in FIG.

8) is set in the drying notification timer 83 on the basis of the drying time table in FIG. 8, and the count of elapsed time is started.

Then, when the counted elapsed time reaches the drying time required for drying ink of the unit area ar, the drying notification timer 83 outputs a drying time end signal to the control unit 81 for notification.

For example, when drawing in the unit area ar1 is performed and ended, at the timing of the end, the drying time "10 seconds" necessary for drying the ink on the unit area ar1 is set in the drying notification timer 83. Then, the drying notification timer 83 starts counting the elapsed time from the end of drawing. When 10 seconds has elapsed, a drying time end signal is output from the drying notification timer 83 to the control unit 81 and notifies the control unit 81 that the predetermined drying time "10 seconds" has elapsed.

When the control unit 81 is notified by the drying notification timer 83 that the predetermined drying time has elapsed, the control unit 81 performs subtraction by "−1" to the value of drawing enable flag which is set in the above-mentioned drawing management table for unit areas ar contacting with the unit area ar.

For example, when the drying notification timer 83 notifies that a predetermined drying time has elapsed for the unit area ar1, the values of the unit areas of area Nos. 2, 4 and 5 contacting with the unit area ar1 are subtracted by "−1".

The photographing control unit 811 controls the cameras 51 and the lights 52 of the photographing unit 50 to photograph images of a finger (hereinafter, called "nail images") including the images of the nail T of the printing finger U1 inserted into the finger receiving unit 31 with the cameras 51.

In the embodiment, the photographing control unit 811 obtains at least two nail images from different positions or angles (for example, from above the nail T and obliquely from above) with the two cameras 51.

The image data of nail images obtained by the photographing unit 50 is stored in the nail image storage area 821 of the storage unit 82.

The nail information detecting unit 812 detects the nail information for the nail T of the printing finger U1 on the basis of the images of the nail T of the printing finger U1 inserted into the finger receiving unit 31 which are obtained by the cameras 51.

Here, the nail information includes the outline of the nail T (the nail shape and horizontal position of the nail T), the inclination angle of the nail T surface with respect to the X-Y plane (inclination angle and nail curvature of nail T), and the height of the nail T (location in the vertical direction of the nail T, hereinafter, called "vertical position of the nail T" or merely called "position of the nail T").

The inclination angle (nail curvature) of the nail T is an angle with respect to the horizontal plane in the width direction of nail T (that is, the X-Y plane of the finger placement unit 116*a* on which the printing finger U1 is placed).

Specifically, the nail information detecting unit 812 detects the outline (shape and size) and position of the nail T from the nail images of the nail T of the printing finger U1 which are obtained by the cameras 51 and obtains the outline as information represented by x and y coordinates and such like.

The nail information detecting unit 812 detects the outline (shape) of the nail T on the basis of the difference in color and such like between the nail T and the other finger portion from the nail images of the nail T of the printing finger U1 obtained by the cameras 51, for example.

The method of detecting the outline (shape) of the nail T by the nail information detecting unit 812 is not especially limited, and not limited to the above examples.

The nail information detecting unit 812 functions as an inclination angle detecting unit which detects the inclination angle (nail curvature) of nail T on the basis of at least two nail images photographed by the two cameras 51.

The nail information detecting unit 812 detects the inclination angle (nail curvature) for the nail T of the user from the two nail images photographed from different positions or angles (for example, from above and obliquely from above the nail T) with the two cameras 51, for example.

The method of detecting the inclination angle (nail curvature) by the nail information detecting unit 812 is not especially limited, and not limited to the above example.

The nail information detecting unit 812 only needs to detect at least the outline (nail shape) of the nail T on the basis of the nail image, and does not need to obtain all of the above nail information.

The drawing data generation unit 813 generates data for the drawing to be performed on the nail T of the printing finger U1 by the drawing head 42 on the basis of the nail information detected by the nail information detecting unit 812.

Specifically, the drawing data generation unit 813 performs a fitting process by enlarging, reducing, cutting out and such like the image data of the nail design on the basis of the shape and such like of the nail T detected by the nail information detecting unit 812, and generates drawing data for performing drawing on the nail T.

In a case where the nail information detecting unit 812 also obtains the inclination angle of nail T (nail curvature) as the nail information, the drawing data generation unit 813 performs curved surface correction of the image data of nail design in accordance with the inclination angle of nail T (nail curvature).

The drawing control unit 814 is a control unit which outputs drawing data generated by the drawing data generation unit 813 to the drawing unit 40 and controls the solenoids 440, the X-direction movement motor 46 and the Y-direction movement motor 48 of the drawing unit 40 so as to perform drawing on the nail T according to the drawing data.

In the embodiment, the drawing control unit 814 controls the drawing operation of the drawing unit 40 to perform drawing for each of the unit areas ar.

Specifically, the drawing control unit 814 controls the drawing operation of the drawing unit 40 to perform drawing on a unit area ar which is only contacting with a dried unit area ar or an un-drawn unit area ar, the dried unit area ar being a unit area ar for which drawing is already performed and the drying notification timer 83 notifies that the drying time has elapsed.

The display control unit 815 controls the display unit 26 to display various display screens on the display unit 26.

In the embodiment, for example, the display control unit 815 makes the display unit 26 display various screens such as a selection screen of nail design, thumbnail images for design confirmation and a nail image obtained by photographing a printing finger U1 including the nail T.

Next, operations and a drawing method of the drawing apparatus 1 in the embodiment will be described.

When drawing is to be performed by the drawing apparatus 1, the user turns on the power switch of the operation unit 25 to activate the control device 80.

The display control unit 815 makes the display unit 26 display the design selection screen.

The user operates a design selection button and such like of the operation unit 25 to select a desired nail design among a plurality of nail designs displayed on the design selection screen.

Thus, a selection instruction signal is output from the operation unit 25 to select the nail design to be drawn on the nail T.

When the nail design is selected, the control unit 81 makes the display unit 26 display an instruction screen which instructs inserting a printing finger U1 into the finger receiving unit 31.

The user inserts the printing finger U1 into the finger receiving unit 31 according to the instruction, inserts the non-printing fingers U2 into the finger resting unit 32 to fix the printing finger U1, and then operates the drawing switch button.

For example, FIG. 3 shows an example in which the ring finger of left hand as the printing finger U1 is inserted into the finger receiving unit 31, and the other fingers as the non-printing fingers U2 are inserted into the finger resting unit 32.

When the instruction is input from the drawing switch, before starting the drawing operation, the photographing control unit 811 controls the photographing unit 50 first to photograph the printing finger U1 with the cameras 51 while illuminating the printing finger U1 with the lights 52.

Thus, the photographing unit 50 obtains images of the nail T (nail image) of the printing finger U1 inserted into the finger receiving unit 31.

Next, the nail information detecting unit 812 detects nail information such as the outline (nail shape) of the nail T on the basis of the nail image.

When the nail information such as the outline (nail shape) of the nail T is detected by the nail information detecting unit 812, the drawing data generation unit 813 performs fitting of the image data of nail design into the nail T on the basis of the nail information.

The drawing data generation unit 813 appropriately performs curved surface correction for the image data of nail design on the basis of the nail information. Thus, the drawing data is generated.

Before starting drawing on the nail T, the drawing control unit 814 moves the drawing unit 40 toward the writing tool test writing unit 61 and drives the solenoid 440 of the writing tool carriage 43 holding the writing tool 41 to enable the writing tool 41 to draw.

Then, test writing is performed by drawing a predetermined figure such as "o" and "∞" on the drawing medium.

The test writing may be performed only for the writing tool 41 necessary to draw the selected nail design or may be performed for all the writing tools 41.

When the drawing data is generated and test writing is also completed, the drawing control unit 814 outputs the drawing data to the drawing unit 40 and drives the solenoid 440 of the writing tool carriage 43 holding the writing tool 41 necessary for the drawing to enable the writing tool 41 to perform drawing, and appropriately moves the drawing head 42 in the X direction and Y direction on the basis of the drawing data to draw the nail design on the nail T.

At that time, the writing tool 41 is pressed against the surface of the nail T by its own weight and performs drawing while moving up and down in accordance with the surface shape of the nail T.

Next, with reference to FIGS. 11 to 18, the drawing processing specific to the drawing apparatus 1 in the embodiment will be described in detail.

Figure 14:
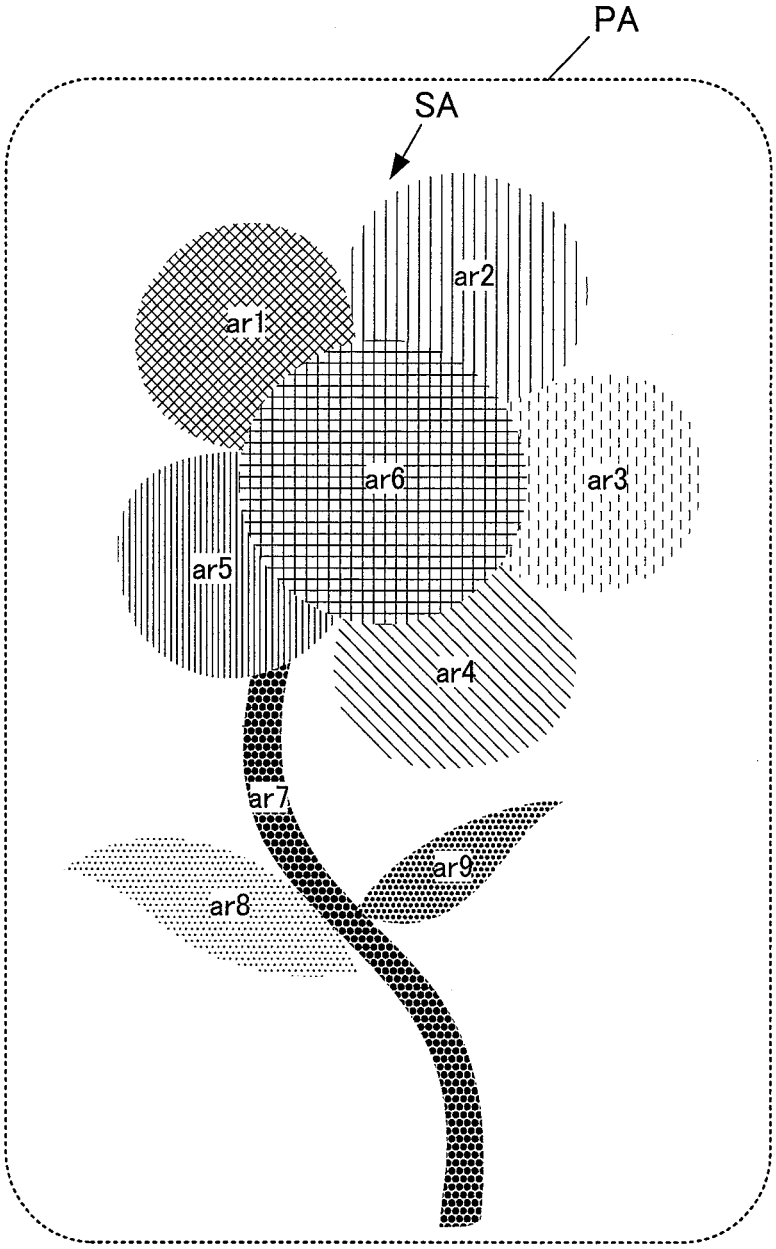
FIG. 14 is a view showing an example of a nail design which can be drawn by the drawing apparatus according to the embodiment.

The following embodiment is described by explaining, as an example, a case where the nail design to be drawn on the drawing target area PA has a flower pattern nail design shown in FIG. 14.

Corresponding to the flower pattern nail design shown in FIG. 14, the segmented area SA has nine unit areas ar (unit areas ar1 to as9) to be drawn by inks of plural mutually different types having plural mutually different colors.

FIG. 15 is a view illustrating an example of area number table 825 in a case where drawing is performed on the basis of drawing data corresponding to the flower pattern nail design shown in FIG. 14.

FIG. 16 is a view illustrating an example of drying time table 826 in a case where drawing is performed on the basis of drawing data corresponding to the flower pattern nail design shown in FIG. 14.

FIG. 17 is a view illustrating an example of surroundings relation table 827 in a case where drawing is performed on the basis of drawing data corresponding to the flower pattern nail design shown in FIG. 14.

FIG. 18 is a view illustrating an example of drawing management table 828 in a case where drawing is performed on the basis of drawing data corresponding to the flower pattern nail design shown in FIG. 14.

In the embodiment, when drawing the nail design, the drawing control unit 814 confirms whether drawing can be performed for the area numbers 1 to 9 in order, and performs drawing from the unit area ar on which drawing can be performed in order.

Figure 11:
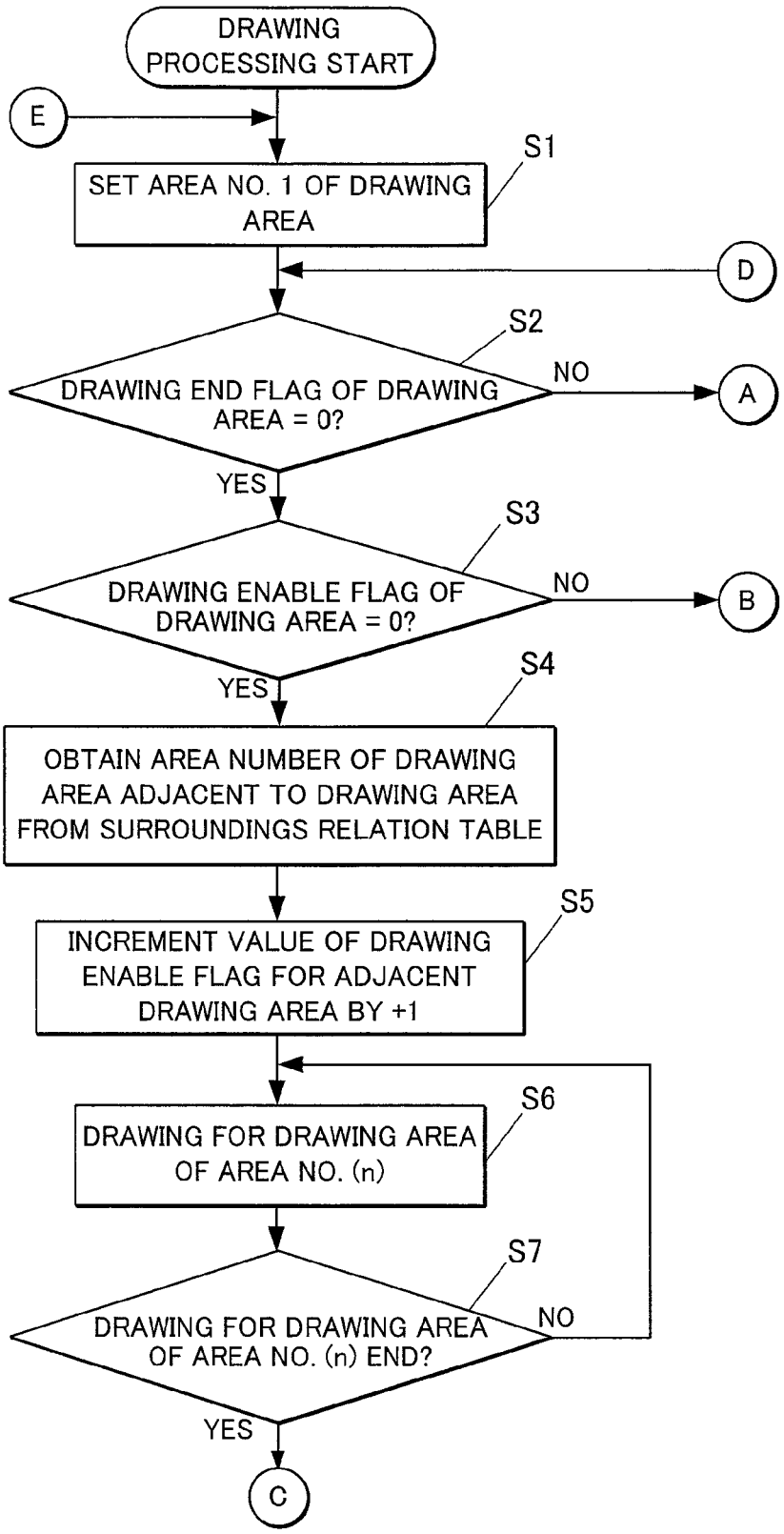
FIG. 11 is a flowchart showing drawing processing of the drawing apparatus according to the embodiment.

Thus, as shown in FIG. 11, the drawing control unit 814 first sets the area No. 1 as the check target (step S1).

Then, the drawing control unit 814 confirms whether the drawing end flag for the area No. 1 is "0" in the drawing management table 828 (step S2).

At this time, as shown in FIG. 18, the drawing end flag of area No. 1 is "0" (step S2; YES). The drawing control unit 814 confirms whether the drawing enable flag is "0" (step S3).

At this time, as shown in FIG. 18, the drawing enable flag of area No. 1 is "0" (step S3; YES). Thus, the drawing control unit 814 determines that drawing is possible for the unit area ar1 of the area No. 1.

Next, the drawing control unit 814 refers to the surroundings relation table and obtains unit areas ar of area Nos. 2, 5 and 6 contacting with the unit area ar1 (step S4).

Then, the drawing control unit 814 increments the value of drawing enable flag for the area Nos. 2, 5 and 6 in the drawing management table by "+1" (step S5).

Then, the drawing control unit 814 starts the drawing by the drawing unit 40 for the unit area ar1 of area No. 1 (step S6).

Next, the drawing control unit 814 determines whether the drawing is finished for the unit area ar1 of area No. 1 (step S7).

If it is not determined that the drawing is finished (step S7; NO), the drawing control unit 814 returns to step S6 to perform drawing processing until the drawing is finished.

Figure 12:
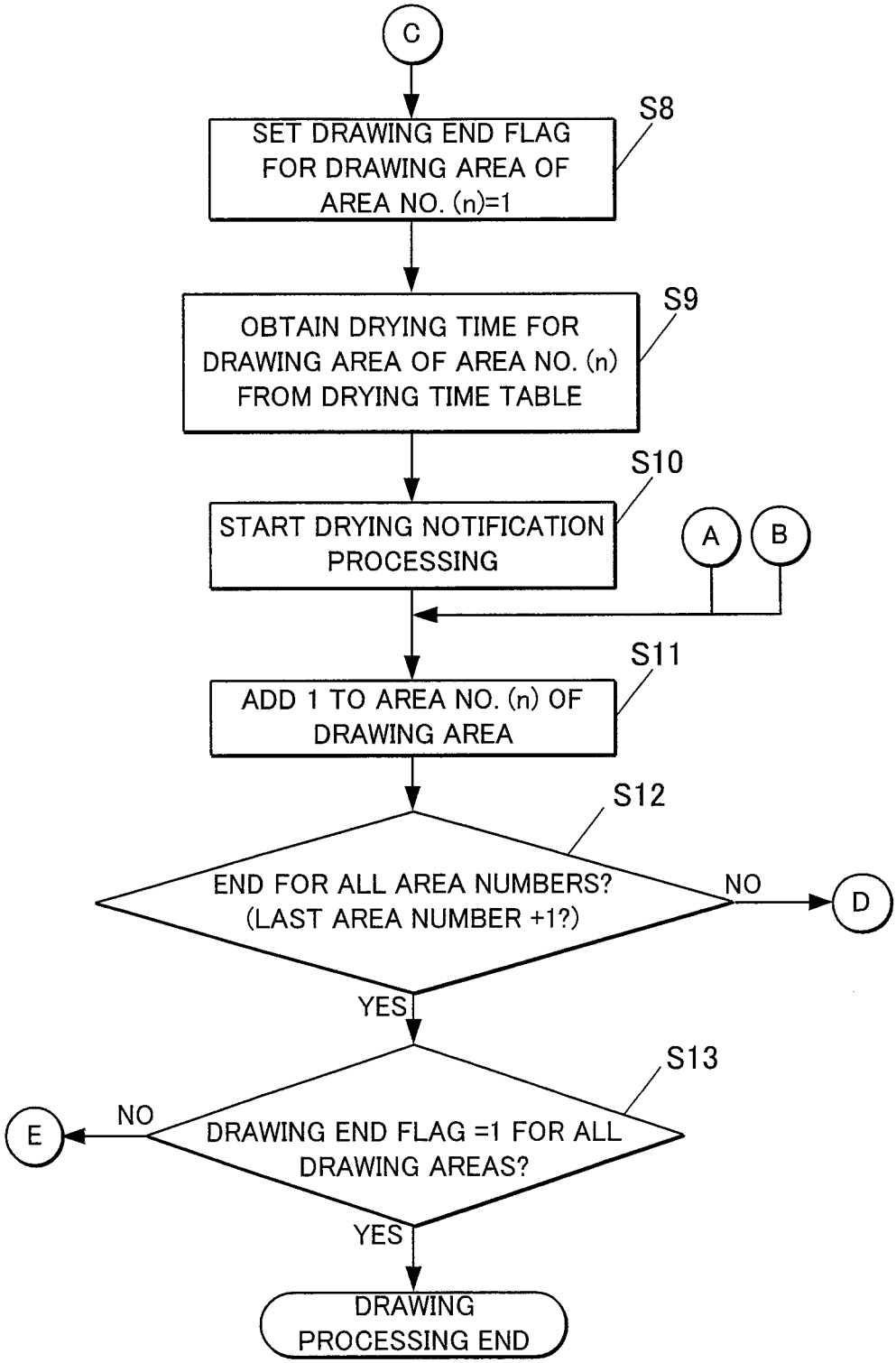
FIG. 12 is a flowchart showing drawing processing of the drawing apparatus according to the embodiment.

On the other hand, if it is determined that drawing is finished for the unit area ar1 of area No. 1 (step S7; YES), as shown in FIG. 12, the drawing control unit 814 sets the drawing end flag of area No. 1 to "1" (step S8).

At this time, the drawing control unit 814 obtains the setting value "10 seconds" of drying time for area No. 1 from the drying time table 826 (step S9), and sets 10 seconds to the drying notification timer 83 to start the drying notification timer 83 (step S10).

When the drying time is set to the drying notification timer 83 to start, the drawing control unit 814 adds 1 to the area number of check target to be 2 (step S11).

Here, the drying notification processing in a case where the drying notification timer 83 is set will be described with reference to FIG. 13.

The drying notification processing is interrupt processing performed every time the drying notification timer 83 is set.

Figure 13:
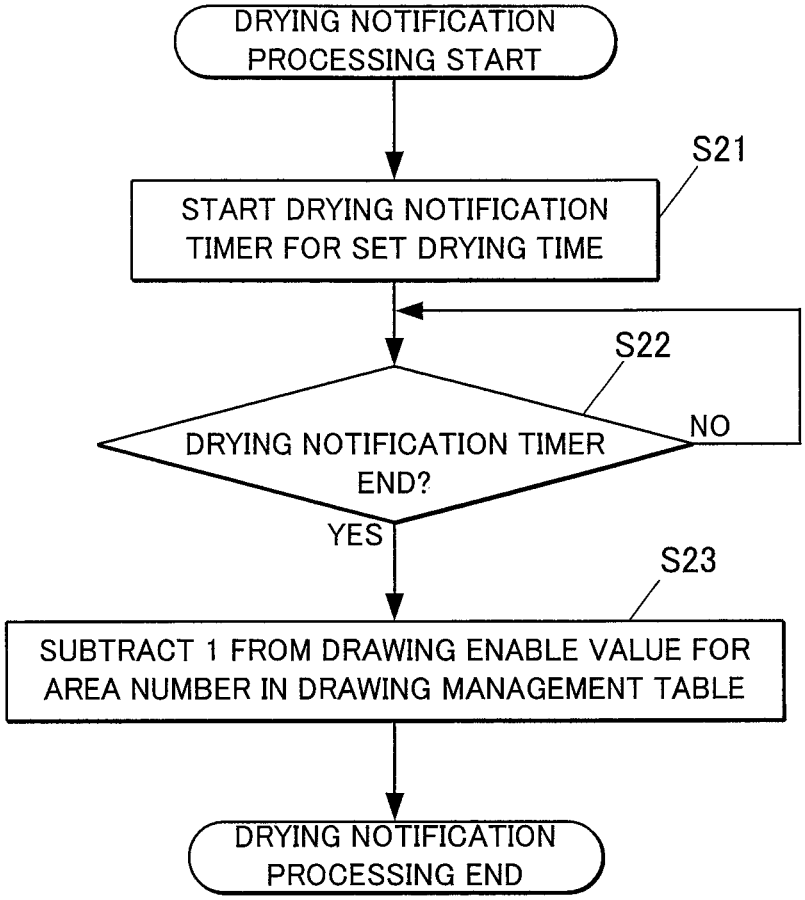
FIG. 13 is a flowchart showing drying notification processing of the drawing apparatus according to the embodiment.

As shown in FIG. 13, the drawing control unit 814 sets drying time to the drying notification timer 83 to start the timer (step S21).

Thus, the drying notification timer 83 starts counting the elapsed time and performs the counting until reaching the value (the setting value "10 seconds" in the above example) of the set drying time.

When the counting ends, IRQ (Interrupt Request) is output as the drying time end signal to the control unit 81.

The drawing control unit 814 determines whether the counting by the drying notification timer 83 ends, that is, whether the IRQ is output from the drying notification timer 83 (step S22), and if the IRQ is not generated from the drying notification timer 83 (step S22; NO), the determination processing is repeated until the IRQ is generated.

If it is determined that the IRQ is output from the drying notification timer 83 and the counting by the drying notification timer 83 is ended (step S22; YES), the drawing control unit 814 performs subtraction of "−1" for the value of drawing enable flag of the area number in the drawing management table 828 (step S23). Thus, the drying notification processing ends.

Returning to FIG. 12, the drawing control unit 814 adds 1 to the area number which is the current check target and sets 2 as the area number of the next check target (step S11).

Then, it is determined whether the drawing processing is finished for all the drawing areas, that is, whether the area number set as the next check target is the value obtained by adding 1 to the last area number (step S12).

If it is determined that the area number of next check target is the value obtained by adding 1 to the last area number (step S12; YES), that is, in the above example, if the area number of next check target is 10 (9+1), it is further determined whether the drawing end flag is "1" for all the unit areas ar (step S13).

If it is determined that the drawing end flag is "1" for all the unit areas ar (step S13; YES), the drawing processing ends.

On the other hand, if it is not determined that the area number (here, the area No. 2) set as the next check target is the value (here, "10") obtained by adding 1 to the last area number (step S12; NO), the processing returns to step S2 in FIG. 11.

Then, the following processing is repeated for the unit area ar of area number set as the next check target (here, the unit area ar2 of area No. 2).

The drawing control unit 814 determines whether the drawing end flag is "0" for the unit area ar2 of area No. 2 (step S2).

In the above example, since drawing is not performed yet in the unit area ar2 of area No. 2, the drawing end flag is "0" (step S2; YES).

The drawing control unit 814 further confirms the drawing enable flag for the area No. 2 (step S3).

If the "10 seconds" of the drying time for the area No. 1 has not elapsed (step S3; NO), the drawing enable flag of the area No. 2 is "1", and thus, the drawing control unit 814 determines that drawing is not possible for the unit area ar2 of the area No. 2.

Then, the drawing control unit 814 adds 1 to the area number of the current check target, and sets the area number of next check target to 3 (step S11).

The determination of step S12 is performed for the area No. 3. Since the area No. 3 is not a value (that is, "10") obtained by adding 1 to the last area number, the processing returns to step S2 and the following processing is repeated similarly.

That is, the drawing control unit 814 determines whether the drawing end flag for the unit area ar3 of the area No. 3 is "0" (step S2).

In the above example, since the drawing is not performed in the unit area ar3 of the area No. 3, the drawing end flag is "0" (step S2; YES).

Then, the drawing control unit 814 further confirms the drawing enable flag for the area No. 3 (step S3).

Since the area No. 3 is the unit area ar which is contacting with only the un-drawn unit areas ar2, ar4 and ar6, the drawing enable flag of the area No. 3 is "0" (step S3; YES). Thus, the drawing control unit 814 determines that drawing is possible for the unit area ar3 of the area No. 3.

The drawing control unit 814 refers to the surroundings relation table and obtains the area Nos. 2, 4 and 6 which are the unit areas ar contacting with the unit area ar3 (step S4), and the values of the drawing enable flags for the area Nos. 2, 4 and 6 in the drawing management table are incremented by "+1" (step S5).

Then, the drawing control unit 814 starts drawing with the drawing unit 40 for the unit area ar3 of area No. 3 (step S6).

Next, the drawing control unit 814 determines whether the drawing is finished for the unit area ar3 of area NO. 3 (step S7).

If it is not determined that the drawing is finished (step S7; NO), the drawing control unit 814 returns to step S6 to perform drawing processing until the drawing is finished.

On the other hand, if it is determined that the drawing is finished for the unit area ar3 of area NO. 3 (step S7; YES), the drawing end flag of area No. 3 is set to "1" (step S8).

At this time, the drawing control unit 814 obtains "12 seconds" which is the setting value of drying time for the area No. 3 from the drying time table 826 (step S9), 12 seconds is set to the drying notification timer 83 and the drying notification timer 83 is started (step S10).

When the drying time is set to the drying notification timer 83 to start the timer, the drawing control unit 814 adds 1 to the area number of the current check target and sets the area number of the check target to 4 (step S11).

Then, the drawing control unit 814 performs determination of step S12 for the area No. 4. Since the area No. 4 is not a value (that is, "10") obtained by adding 1 to the last area number, the processing returns to step S2 and the following processing is repeated similarly.

That is, the drawing control unit 814 determines whether the drawing end flag is "0" for the unit area ar4 of area No. 4 (step S2).

In the above example, since the drawing is not performed in the unit area ar4 of the area No. 4, the drawing end flag is "0" (step S2; YES).

Then, the drawing control unit 814 further confirms the drawing enable flag for the area No. 4 (step S3).

Here, the area No. 4 is the unit area ar which is contacting with the area No. 3, and if the drying time 12 seconds of the area No. 3 has not elapsed (step S3; NO), the drawing enable flag of the area No. 4 is "1". Thus, the drawing control unit 814 determines that drawing is not possible for the unit area ar4 of the area No. 4.

Then, the drawing control unit 814 adds 1 to the area number of the current check target and sets the area number of next check target to 5 (step S11).

Then, the drawing control unit 814 performs determination of step S12 for the area No. 5. Since the area No. 5 is not a value (that is, "10") obtained by adding 1 to the last area number, the processing returns to step S2 and the following processing is repeated similarly.

That is, the drawing control unit 814 determines whether the drawing end flag is "0" for the unit area ar5 of area No. 5 (step S2).

In the above example, since the drawing is not performed in the unit area ar5 of the area No. 5, the drawing end flag is "0" (step S2; YES).

Then, the drawing control unit 814 further confirms the drawing enable flag for the area No. 5 (step S3).

Here, the area No. 5 is the unit area ar which is contacting with the area No. 1, and if the drying time 10 seconds of the area No. 1 has not elapsed (step S3; NO), the drawing enable flag of the area No. 5 is "1". Thus, the drawing control unit 814 determines that drawing is not possible for the unit area ar5 of the area No. 5.

On the other hand, if the drying time 10 seconds of the area No. 1 has elapsed (step S3; YES), the value of the drawing enable flag for the area No. 5 is reduced by subtracting 1 from "1" to be "0". Thus, the drawing control unit 814 determines that drawing is possible for the unit area ar5 of the area No. 5.

After the drawing was performed for the area No. 1, a period of time to some degree has elapsed until the drawing control unit 814 determines whether drawing is possible for the area No. 5. Thus, in a case where 10 seconds has elapsed for the period of time, the drawing enable flag of area No. 5 is "0" to enable drawing on the area No. 5. That is, whether drawing is possible on the area No. 5 depends on the length of time which was required for the drawing processing for the unit area ar3 of area No. 3.

The embodiment takes, as an example, a case where the time which was required for the drawing processing for the unit area ar3 of area No. 3 exceeds 10 seconds. In this case, at the time when the drawing control unit 814 determines possibility of drawing processing for the area No. 5, the drying notification timer 83 has already notified that the drying time required for drying ink for the unit area ar of area No. 1 elapsed.

In this case, the drawing enable flag of area No. 5 is "0", and the drawing control unit 814 determines that drawing is possible for the unit area ar of area No. 5.

The drawing control unit 814 refers to the surroundings relation table and obtains the area Nos. 1, 4, 6 and 7 of the unit areas ar contacting with the unit area ar5 (step S4).

Then, the values of the drawing enable flag of the area Nos. 1, 4, 6 and 7 in the drawing management table are incremented by "+1" (step S5).

For the area NO. 1, the value of the drawing enable flag may not be incremented since the drawing processing has been already finished.

Then, the drawing control unit 814 starts drawing with the drawing unit 40 for the unit area ar5 of area No. 5 (step S6).

The drawing control unit 814 determines whether the drawing is finished for the unit area ar5 of area NO. 5 (step S7).

If it is not determined that the drawing is finished (step S7; NO), the drawing control unit 814 returns to step S6 to perform drawing processing until the drawing is finished.

On the other hand, if it is determined that the drawing is finished for the unit area ar5 of area NO. 5 (step S7; YES), the drawing end flag of area No. 5 is set to "1" (step S8).

At this time, the drawing control unit 814 obtains "5 seconds" which is the setting value of drying time of the area No. 5 from the drying time table 826 (step S9), and sets 5 seconds to the drying notification timer 83 to start the drying notification timer 83 (step S10).

When the drying time is set to the drying notification timer 83 to start the timer, the drawing control unit 814 adds 1 to the area number of the current check target and sets the area number of the check target to 6 (step S11).

Then, the drawing control unit 814 performs determination of step S12 for the area No. 6. Since the area No. 6 is not a value (that is, "10") obtained by adding 1 to the last area number, the processing returns to step S2 and the following processing is repeated similarly.

That is, the drawing control unit 814 determines whether the drawing end flag is "0" for the unit area ar6 of area No. 6 (step S2).

In the above example, since the drawing is not performed in the unit area ar6 of the area No. 6, the drawing end flag is "0" (step S2; YES).

Then, the drawing control unit 814 further confirms the drawing enable flag for the area No. 6 (step S3).

Here, the area No. 6 is the unit area ar which is contacting with the area Nos. 1 to 5. In a case where drawing is already performed in the area Nos. 1 and 3, for example, if the drying time 10 seconds of the area No. 1 and the drying time 12 seconds of the area No. 3 have not elapsed (step S3; NO), the drawing enable flag of the area No. 6 is "2". Thus, the drawing control unit 814 determines that drawing is not possible for the unit area ar6 of the area No. 6.

Then, the drawing control unit 814 adds 1 to the area number of the current check target and sets the area number of next check target to 7 (step S11).

The drawing control unit 814 performs determination of step S12 for the area No. 7. Since the area No. 7 is not a value (that is, "10") obtained by adding 1 to the last area number, the processing returns to step S2 and repeats the following processing similarly.

At this time point, there is a possibility that the drawing enable flag of area NO. 6 is "3" at a maximum since addition is performed when the drawing is performed for the area Nos. 1, 3 and 5.

However, in a case where the drawing time, of area No. 5 is longer than 12 seconds, the drawing enable flag set when the drawing of area No. 3 was finished is also reduced by "−1", and thus, the drawing enable flag of area NO. 6 is "1", not "2".

In a case where the drawing time of area No. 5 is shorter than 12 seconds, the drawing enable flag of area NO. 6 is "2".

Here, since there is a drawing enable flag set when the drawing is finished for area NO. 5, the drawing enable flag is not "0" in either case, and the drawing control unit 814 determines that drawing is not possible for the unit area ar of the area No. 6.

Then, the drawing control unit 814 adds 1 to the area number of the current check target and sets the area number of next check target to 7 (step S11).

Then, the drawing control unit 814 performs determination of step S12 for the area No. 7. Since the area No. 7 is not a value (that is, "10") obtained by adding 1 to the last area number, the drawing control unit 814 returns to step S2 and repeats the following processing similarly.

Since the drawing end flag of area No. 7 is "0" (step S2; YES), the drawing control unit 814 confirms the drawing enable flag for the area No. 7 (step S3).

The area No. 7 is contacting with the area Nos. 5, 8 and 9, and drawing is already performed in the area NO. 5. Thus, the drawing enable flag of area No. 7 is "1".

When the drawing control unit 814 determines possibility of drawing, if the drying time of area No. 5 has elapsed and the drawing enable flag is "0", drawing would be possible. However, the determination regarding possibility of drawing by the drawing control unit 814 is performed instantly, and thus, when the drawing control unit 814 determines the possibility of drawing, 5 minutes or more will not have elapsed from the end of drawing for the unit area No. 5.

Thus, the drawing enable flag of area No. 7 remains to "1", and the drawing control unit 814 determines that drawing is not possible for the unit area ar7 of area No. 7.

Then, the drawing control unit 814 adds 1 to the area number of the current check target and number of next check target to 8 (step S11).

The determination of step S12 is performed for the area No. 8. Since the area No, 8 is not a value (that is, "10") obtained by adding 1 to the last area number, the drawing control unit 814 returns to step S2 and repeats following processing similarly.

That is, the drawing control unit 814 determines whether the drawing end flag is "0" for the unit area ar8 of area No. 8 (step S2).

In the above example, since the drawing is not performed in the unit area ar8 of the area No. 8, the drawing end flag is "0" (step S2; YES).

Then, the drawing control unit 814 further confirms the drawing enable flag for the area No. 8 (step S3).

Here, the area No. 8 is the unit area ar which is contacting with the area No. 7, and drawing is not performed in the area No. 7 at this time. Thus, the drawing enable flag of area No. 8 is "0".

Thus, the drawing control unit 814 determines that drawing is possible for the unit area ar8 of area NO. 8, and sets the drawing enable flag of area No. 7 contacting with the unit area ar8 of area No. 8 to "1" (step S5).

Then, the drawing control unit 814 performs drawing processing for the unit area ar8 of area No. 8 (step S6).

When the drawing processing is finished (step S7; YES), the drawing control unit 814 sets the drawing end flag of area No. 8 to "1" (step S8).

At this time, the setting value "11 seconds" of drying time of area No. 8 is set to the drying notification timer 83 and starts counting the elapsed time.

When the drying time is set to the drying notification timer 83 to start counting, the drawing control unit 814 adds 1 to the area number of current check target and sets the area number of check target to 9 (step S11).

Then, the drawing control unit 814 performs determination of step S12 for the area No. 9. Since the area No. 9 is not a value (that is, "10") obtained by adding 1 to the last area number, the drawing control unit 814 returns to step S2 and repeats following processing similarly.

That is, the drawing control unit 814 determines whether the drawing end flag is "0" for the unit area 9 of area No. 9 (step S2).

In the above example, since drawing is not performed yet for the unit area ar9 of area No. 9, the drawing end flag is "0" (step S2; YES).

Then, the drawing control unit 814 further confirms the drawing enable flag for the area No. 9 (step S3).

Since the area No. 9 is contacting with the area NO. 7 and drawing is not performed in the area No. 7 at this time, the drawing enable flag of area No. 9 is "0".

Thus, the drawing control unit 814 determines that drawing is possible for the unit area ar9 of are No. 9, and the value of drawing enable flag of area No. 7 contacting with the unit area ar9 of area No. 9 is incremented by "+1" (step S5). Thus, the drawing enable flag of area No. 7 is "2".

Then, drawing processing is performed for the unit area ar9 of area No. 9 (step S6).

When the drawing processing is finished (step S7; YES), the drawing control unit 814 sets the drawing end flag of area No. 9 to "1" (step S8).

At this time, the setting value "11" of drying time of area NO. 9 is set to the drying notification timer 83 to start counting the elapsed time.

When the setting value of drying time is set to the drying notification timer 83 to start counting the elapsed time, the drawing control unit 814 adds 1 to the area number of current check target and sets the area number of next check target to 10 (step S11).

The drawing control unit 814 determines whether the drawing processing is finished for all the drawing areas, that is, whether the area number set as the next check target is the value obtained by adding 1 to the last area number (step S12).

If it is determined that the area number is the value obtained by adding 1 to the last area number (step S12; YES), that is, in the above example, if the area number is 10 (9+1), the drawing control unit 814 further determines whether the drawing end flag is "1" for all the unit areas ar (step S13).

In the above example, since the drawing end flag is not "1" for all the unit areas ar (step S13; NO), the drawing control unit 814 sets area No. 1 again as the area number of check target (step S1), and repeats the processing following step S1.

That is, first, drawing is already performed and the drawing end flag is "1" for the area No. 1, and thus, the drawing control unit 814 proceeds to step S11 and number of check target to 2.

Then, the drawing control unit 814 performs determination of step S12 for the area No. 2. Since the area No. 2 is not a value (that is, "10") obtained by adding 1 to the last area number, the drawing control unit 814 returns to step S2 and repeats following processing similarly.

In the above example, since drawing is not performed in the area No. 2, the drawing end flag is "0" (step S2; YES).

The drawing control unit 814 further confirms the drawing enable flag for the area No. 2 (step S3).

Here, the area No. 2 is contacting with the area Nos. 1, 3 and 6, and drawing is already performed for the area Nos. 1 and 3.

In this case, if the drying time 10 seconds of area No. 1 and the drying time 12 seconds of area No. 3 have not elapsed (step S3; NO), the drawing enable flag of area No. 2 is "2", and thus, the drawing control unit 814 determines that drawing is not possible for the unit area ar of area No. 2.

Here, the description is made for a case where the elapse of drying time is notified (timer IRQ is generated) from the drying notification timer 83 set for the area Nos. 1 and 3 while drawing in the area Nos. 5, 8 and 9.

In this case, the drawing enable flag of area No. 2 is "0" and the drawing control unit 814 determines that drawing is possible for the unit area ar2 of area NO. 2.

When determining that drawing is possible for the unit area ar of area NO. 2, the drawing control unit 814 increments the drawing enable flags of area Nos. 1, 3 and 6 contacting with the unit area ar2 of area No. 2 by "+1" (step S5).

Then, the drawing control unit 814 performs drawing processing for the unit area ar2 of area No. 2 (step S6).

When the drawing processing is finished (step S7; YES), the drawing control unit 814 sets the drawing end flag of area No. 2 to "1" (step S8).

At this time, the drawing control unit 814 sets the setting value "8 seconds" of drying time of area NO. 2 to the drying notification timer 83 to start counting the elapsed time.

When setting a setting value of drying time to the drying notification timer 83 to start counting elapsed time, the drawing control unit 814 adds 1 to the area number of current check target and sets the area number of next check target to 3 (step S11).

For the area No. 3, drawing is already performed and the drawing end flag is "1". Thus, the drawing control unit 814 proceeds to step S11 and sets the area number of next check target to 4.

Then, the drawing control unit 814 performs determination of step S12 for the area No. 4. Since the area No. 4 is not a value (that is, "10") obtained by adding 1 to the last area number, the drawing control unit 814 returns to step S2 and repeats following processing similarly.

In the above example, for the area No. 4, since drawing is not performed yet, the drawing end flag is "0" (step S2; YES).

Thus, the drawing control unit 814 further confirms the drawing enable flag for the unit area No. 4 (step S3).

Here, the area NO. 4 is contacting with the area Nos. 3, 5 and 6 and drawing is already performed in the area Nos. 3 and 5.

In this case, if the drying time 12 seconds of area NO. 3 and drying time 5 seconds of area NO. 5 have not elapsed (step S3; NO), the drawing enable flag of area No. 4 is "2", and thus, the drawing control unit 814 determines that drawing is not possible for the unit area ar of area No. 2.

Here, the description is made for a case where the elapse of drying time is notified (timer IRQ is generated) from the drying notification timer 83 set for the area Nos. 1 and 3 while drawing in a unit area ar of another area number.

In this case, the drawing enable flag of area No. 4 is "0", and the drawing control unit 814 determines that drawing is possible for the unit area ar4 of area No. 4.

When determining that drawing is possible for the unit area ar4 of area No. 4, the drawing control unit 814 increments the drawing enable flags of area nos. 3, 5 and 6 contacting with the unit area ar of area No. 4 by "+1" (step S5).

Then, drawing processing is performed for the unit area ar of are No. 4 (step S6).

When the drawing processing is finished (step S7; YES), the drawing control unit 814 sets the drawing end flag of area No. 4 to "1" (step S8).

At this time, the drawing control unit 814 sets the setting value "8" of drying time of area No. 4 to the drying notification timer 83 to start counting the elapsed time.

When setting the setting value of drying time to the drying notification timer 83 to start counting the elapsed time, the drawing control unit 814 adds 1 to the area number of the current check target and sets the area number of next check target to 5 (step S11).

Then, the drawing control unit 814 performs determination of step S12 for the area No. 5. Since the area No. 5 is not a value (that is, "10") obtained by adding 1 to the last area number, the drawing control unit 814 returns to step S2 and repeats following processing similarly.

That is, the drawing control unit 814 determines whether the drawing end flag is "0" for the unit area ar5 of are No. 5 (step S2).

For the area No. 5, drawing is already performed and the drawing end flag is "1".

Thus, the drawing control unit 814 proceeds to step S11 and sets the area number of next check target to 6.

Then, the drawing control unit 814 performs determination of step S12 for the area No. 6. Since the area No. 6 is not a value (that is, "10") obtained by adding 1 to the last area number, the drawing control unit 814 returns to step S2 and repeats following processing similarly.

In the above example, for the area No. 6, drawing is not performed, and thus, the drawing end flag is "0" (step S2; YES).

Thus, the drawing control unit 814 further confirms the drawing enable flag of area No. 6 (step S3).

Here, the area No. 6 is contacting with the area Nos. 1, 2, 3, 4 and 5.

Drawing is already performed in the area Nos. 1, 2, 3, 4 and 5, and the drawing enable flag of area No. 6 is likely to be "5" at a maximum.

As performing drawing processing in another unit area ar, drying of ink in the area Nos. 1, 2, 3, 4 and 5 contacting with the area No. 6 also proceeds, the drying notification timer 83 sequentially notifies the elapse of drying time, and the drawing enable flag of area No. 6 is being reduced.

However, it is unlikely that the drying time of area No. 4 on which drawing is performed immediately before has elapsed when the drawing control unit 814 determines possibility of drawing processing for the area No. 6. Thus, at least, the drawing enable flag of area No. 6 is "1".

Thus, the drawing control unit 814 determines that drawing is not possible for the unit area ar of area No. 6.

Then, the drawing control unit 814 adds 1 to the area number of current check target and sets the area number of next check target to 7 (step S11).

Then, the drawing control unit 814 performs determination of step S12 for the area No. 7. Since the area No. 7 is not a value (that is, "10") obtained by adding 1 to the last area number, the drawing control unit 814 returns to step S2 and repeats following processing similarly.

Since the drawing end flag is "0" for the area No. 7 (step S2; YES), the drawing control unit 814 confirms the drawing enable flag for the area No. 7 (step S3).

Here, the area No. 7 is contacting with the area Nos. 5, 8 and 9, and drawing is already performed in the area Nos. 5, 8 and 9. Thus, the drawing enable flag of area No. 7 is "3" at a maximum.

Here, the description is made for a case where the elapse of drying time is notified (timer IRQ is generated) from the drying notification timer 83 set for the area Nos. 5, 8 and 9 while drawing in a unit area ar of another area number.

In this case, the drawing enable flag of area No. 7 is "0", and the drawing control unit 814 determines that drawing is possible for the unit area ar7 of area No. 7.

When determining that drawing is possible for the unit area ar7 of are No. 7, the drawing control unit 814 increments the drawing enable flags of area Nos. 5, 8 and 9 contacting with the unit area ar of are No. 7 by "+1" (step S5).

Then, the drawing control unit 814 performs drawing processing for the unit area ar7 of are No. 7 (step S6).

When the drawing processing is finished (step S7; YES), the drawing control unit 814 sets the drawing end flag of area No. 7 to "1" (step S8).

At this time, the drawing control unit 814 sets the setting value "8 seconds" of drying time of area No. 7 to the drying notification timer 83 to start counting the elapsed time.

When setting the setting value of drying time to the drying notification timer 83 to start counting the elapsed time, the drawing control unit 814 adds 1 to the area number of current check target and sets the area number of next check target to 8 (step S11).

Then, the drawing control unit 814 performs determination of step S12 for the area No. 8. Since the area No. 8 is not a value (that is, "10") obtained by adding 1 to the last area number, the drawing control unit 814 returns to step S2 and repeats following processing similarly.

Here, for the area NO. 8, drawing is already performed, and the drawing end flag is "1". Thus, the drawing control unit 814 proceeds to step S11, and sets the area number of check target to 9.

Then, the drawing control unit 814 performs determination of step S12 for the area No. 9. The area No. 9 is not a value (that is, "10") obtained by adding 1 to the last area number, and thus, the drawing control unit 814 returns to step S2 and repeats following processing similarly.

Also for the area No. 9, drawing is already performed and the drawing end flag is "1". Thus, the drawing control unit 814 proceeds to step S11, and sets the area number of next check target to 10.

Then, the drawing control unit 814 performs determination of step S12 for the area No. 10. The area No. 10 is the value (that is, "10") obtained by adding 1 to the last area number. Thus. The drawing control unit 814 further determines whether the drawing end flags are "1" for all the unit areas ar (step S13).

In the above example, the drawing end flags are not "1" for all the unit areas ar (step S13; NO). Thus, the drawing control unit 814 number of check target to 1 again (step S1), and repeats the processing following step S1.

That is, the drawing control unit 814 confirms the drawing end flag again in order from area No. 1. Since the drawing end flag of area NO. 1 is "1", the drawing control unit 814 proceeds to step S11 and sets the area number of next check target to 2.

Since the drawing end flag of area No. 2 is also "1", the drawing control unit 814 proceeds to step S11 and sets the area number of next check target to 3.

In such way, the drawing control unit 814 repeats determination by moving forward the area number in order, and if the drawing end flag is "0" for any area number, the drawing control unit 814 further confirms the drawing enable flag for the area number.

In the embodiment, at this time, the drawing end flag is "0" only for the area No. 6 (step S2; YES). Thus, the drawing control unit 814 confirms the drawing enable flag for the area No. 6 (step S3).

Here, the area No. 6 is contacting with the area Nos. 1, 2, 3, 4 and 5, and drawing is already performed in the area Nos. 1, 2, 3, 4 and 5. Thus, the drawing enable flag of area No. 6 is "5" at a maximum.

Here, the description is made for a case where the elapse of drying time is notified (timer IRQ is generated) from the drying notification timer 83 set for the area Nos. 1, 2, 3, 4 and 5 while drawing in the unit area ar of another area number. In this case, the drawing enable flag of area NO. 6 is "0", and the drawing control unit 814 determines that drawing is possible for the unit area ar of area No. 6.

When determining that drawing is possible for the unit area ar6 of area No. 6, the drawing control unit 814 increments the drawing enable flag of area Nos. 1, 2, 3, 4 and 5 contacting with the unit area ar6 of area No. 6 by "+1" (step S5).

Then, the drawing control unit 814 performs drawing processing for the unit area ar6 of area No. 6 (step S6).

When the drawing processing is finished (step S7; YES), the drawing control unit 814 sets the drawing end flag of area No. 6 to "1" (step S8).

At this time, the drawing control unit 814 sets the setting value of drying time "7 seconds" of area NO. 6 to the drying notification timer 83 to start counting the elapsed time.

When the setting value of drying time is set to the drying notification timer 83 to start counting the elapsed time, the drawing control unit 814 adds 1 to the area number of the current check target and sets the area number of next check target to 7 (step S11).

Then, the drawing control unit 814 performs determination of step S12 for the area No. 7. Since the area No. 7 is not a value (that is, "10") obtained by adding 1 to the last area number, the drawing control unit 814 returns to step S2 and repeats following processing similarly.

The same determination is performed for the area Nos. 8 and 9.

When 1 is added to the check target area number to be 10, the drawing control unit 814 further determines whether the drawing end flags of all the unit areas ar are "1" (step S13).

In the above example, at this time, the drawing end flag is "1" for all the unit areas ar (step S13; YES).

Thus, the drawing control unit 814 determines that the drawing processing is completed for all the unit areas ar and ends the drawing processing.

As described above, according to the embodiment, drawing is controlled to be performed for a unit area ar which is contacting with only a unit area ar for which drawing is already performed, elapse of drying time of applied ink is notified and the drying of the ink is finished or an un-drawn unit area ar to which ink is not applied.

Thus, in a case where a nail design is to be drawn by inks different from each other on respective areas contacting with each other, it is possible to prevent colors of inks being mixed at a border portion between the areas and perform high accurate nail printing.

Furthermore, since the drawing control unit 814 determines an area on which drawing is possible while determining, as needed, an area in which mixed color of ink is not to be generated, the waiting time of waiting for the dry of ink can be shortened as much as possible. Thus, the increase of time required for drawing processing can be suppressed while maintaining the quality of drawing.

Here, the apparatus includes a drying notification timer which starts counting elapsed time when drawing by the drawing unit 40 is finished for a unit area ar and notifies the elapse of time when the elapsed time reaches the drying time required for drying the ink of the unit area ar, and the unit area ar for which the elapse of drying time is notified by the drying notification timer is the dried unit area ar. Thus, only the unit area for which drying time has surely elapsed can be treated as the dried unit area ar, and the determination of the unit area ar for which drawing is possible can be accurately performed.

The drawing unit 40 includes a drawing tool 41 which performs drawing by contacting the surface of nail T with a tip portion thereof. This enables a drawing which is not translucent, and, drawing can be performed by also using ink including color material which has relatively large particle diameter and lame as used in nail polish on the market, ink with high viscosity and such like. This increases the degree of freedom for the type of ink which can be used in the drawing apparatus 1 compared to a print apparatus using an ink-jet type, for example.

Then, since the ink including a color material having a relatively large particle diameter and lame and ink with high viscosity are relatively difficult to dry, the colors of inks are easily mixed when they are applied so as to be contacting with each other. With respect to this, in the embodiment, since drawing is controlled to be performed for a unit area ar which is only contacting with the dried unit area ar for which drawing is already performed and elapse of drying time is notified or the un-drawn unit area ar, drawing operation can be performed efficiently and promptly while preventing defection of image due to the color mixture of ink and such like, even in a case of using the above inks.

Though the embodiment of the present invention has been described above, it goes without saying that the present invention is not limited to the embodiment, and various changes can be made within the scope of the invention.

For example, the configuration of drawing unit 40 is not limited to that of embodiment.

Figure 19:
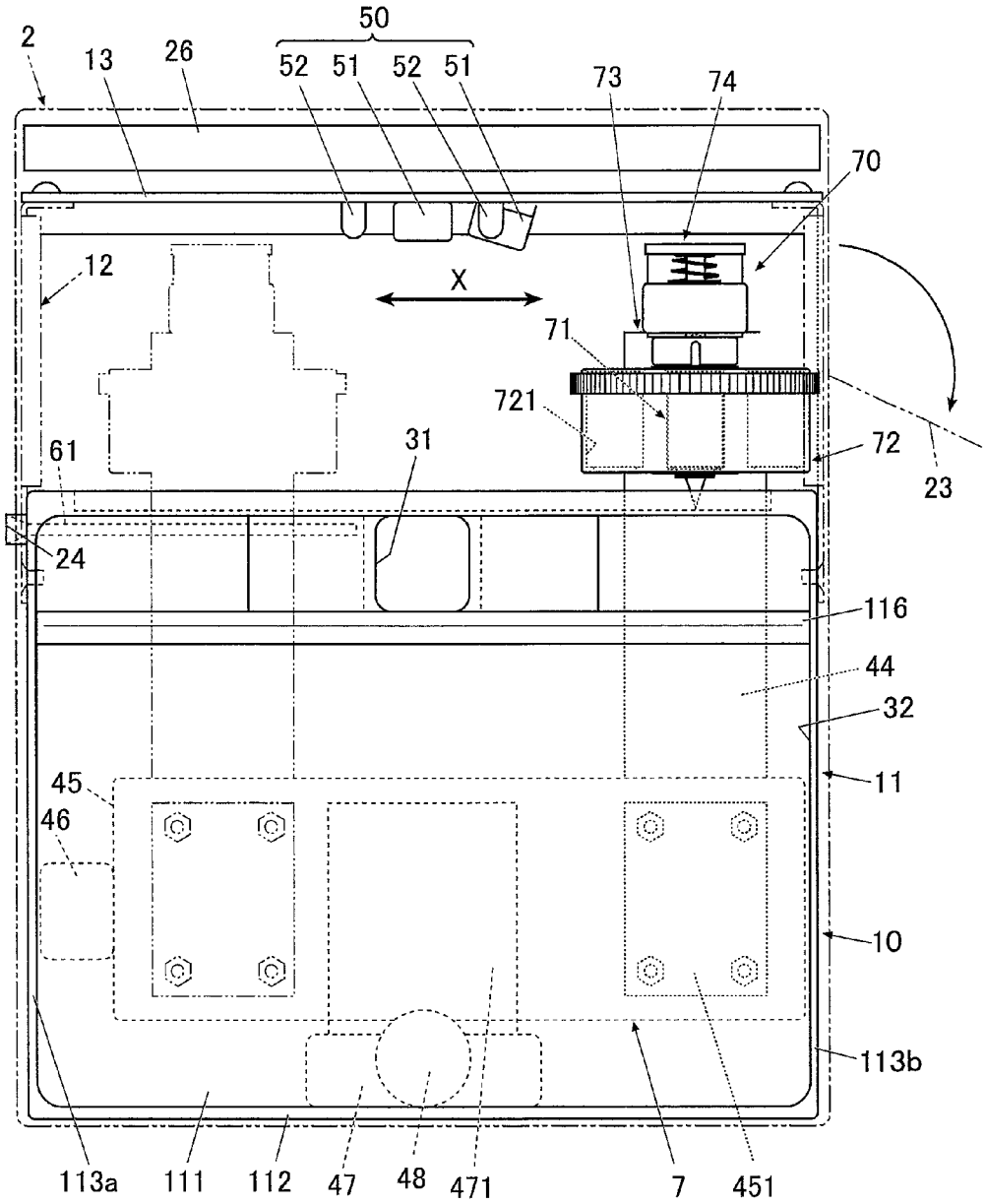
FIG. 19 is a front view of a modification example of the drawing apparatus in the embodiment.
Figure 20:
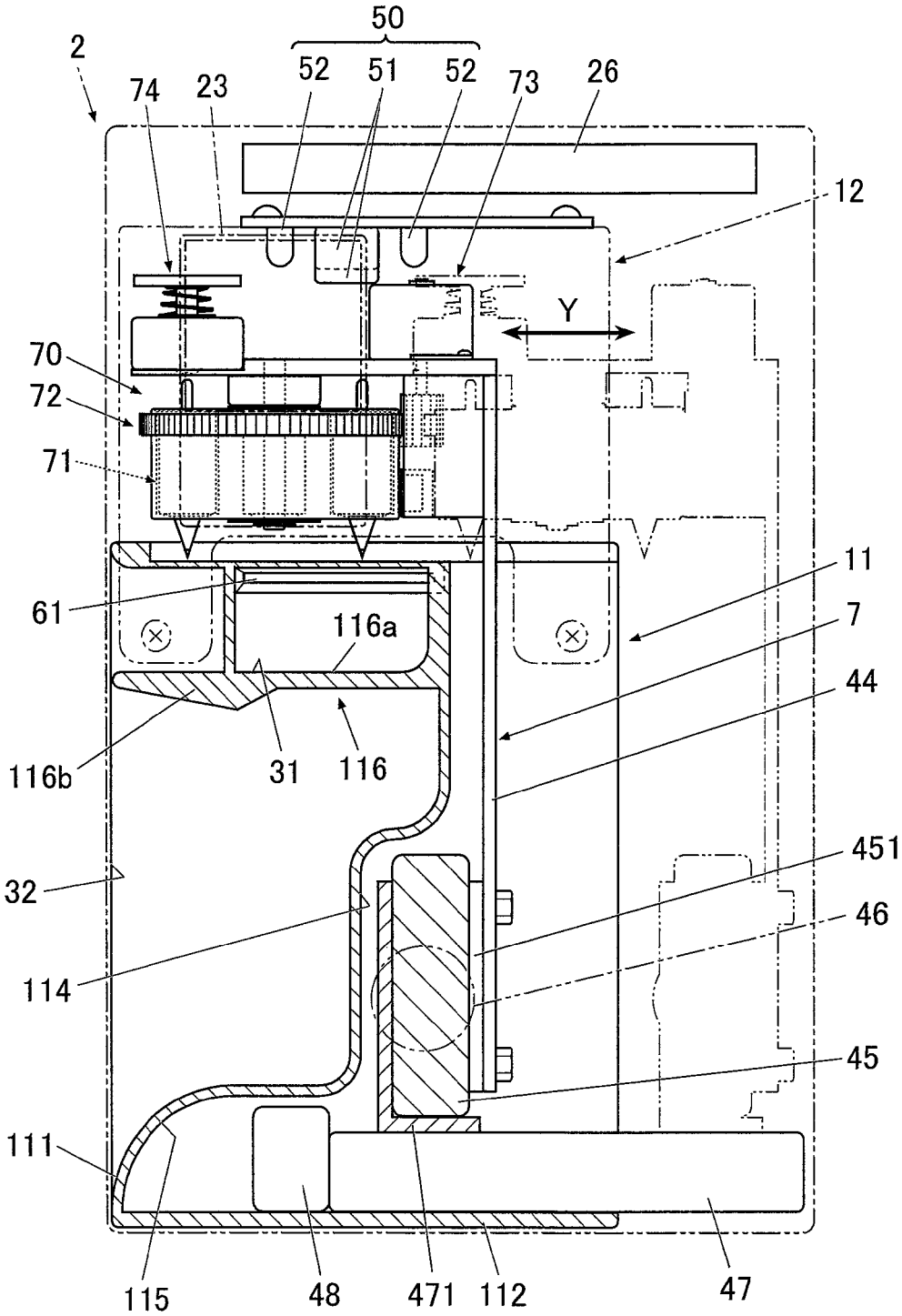
FIG. 20 is a lateral view of a cross section of a part of the drawing apparatus shown in FIG. 19, showing an internal configuration thereof.

FIGS. 19 and 20 show an example of a drawing apparatus equipped with a drawing unit 7 which is different from that of the embodiment.

FIG. 19 is a front view of an apparatus main body of drawing apparatus 1.

FIG. 20 is a lateral view of a cross section of a part of the drawing apparatus shown in FIG. 19, showing the internal configuration.

As shown in FIGS. 19 and 20, a drawing head 70 of the drawing unit 7 includes a writing tool carriage 72 which is rotary and can hold a plurality of (for example, eight) writing tools 71, a carriage rotating mechanism 73 which rotates the writing tool carriage 72, and a writing tool lifting mechanism 74 which moves a writing tool 71 held by the writing tool carriage 72 up and down.

In this case, as shown in FIG. 19, a writing tool replacement cover 23 configured to be openable and closable for removing and replacing a writing tool 71 is provided at a position corresponding to after-mentioned drawing head 70 on a lateral surface of the case main body 2.

The writing tool replacement cover 23 is rotatable from a closed state to an open state as shown in FIG. 19 via a hinge, for example.

The writing tool carriage 72 in the embodiment is formed to be cylindrical and a plurality of (eight, for example) writing tool holding units 721 holding writing tools 71 are disposed along the circumference direction of the writing tool carriage 72.

The numbers of the writing tools 71 and the writing tool holding units 721 holding the writing tools 71 are not especially limited, and the numbers may be larger than eight and may be smaller than eight.

An apparatus including more writing tool holding units 721 to hold a plurality of writing tools 71 can draw a complicated nail design using more inks.

All the writing tool holding units 721 do not need to hold writing tools 71, and the writing tools 71 may be held by only a part of the writing tool holding units 721.

The writing tool carriage 72 is configured to be rotatable by a predetermined amount by the carriage rotating mechanism 73 configured by a stepping motor, for example, and when the writing tool 71 used for drawing is selected, the writing tool carriage 72 is rotated so as to locate the writing tool 71 below the writing tool lifting mechanism 74.

The writing tool lifting mechanism 74 is configured by a solenoid or the like, and presses the writing tool 71 disposed below the writing tool lifting mechanism 74 to the position contacting the nail T surface when drawing is performed. Thus, the pen tip of the writing tool 71 is pressed onto the nail T surface with an appropriate pressure to enable drawing.

The configuration of carriage rotating mechanism rotating the writing tool carriage 72, the configuration of the writing tool lifting mechanism pressing down the writing tool 71, and such like are not limited to example illustrated here. For example, the carriage rotating mechanism may be configured by a ratchet mechanism, a solenoid and such like.

The drawing apparatus configured as described above can perform drawing by holding a plurality of types (eight types at a maximum in the embodiment) of writing tools 71 at the same time.

Thus, for example, it is possible to easily draw even a complicated and delicate design requiring many colors such as a rainbow pattern requiring seven colors of ink, a gradation pattern requiring a plurality of inks forming a gradation of density, argyle pattern using various colors and such like.

The embodiment has been described by taking, as an example, a case where the drawing control unit 814 repeats the determination regarding possibility of drawing for a unit area ar in order for all the area numbers until the drawing is completed for all the unit areas ar; however, the determination method by the drawing control unit 814 is not limited to the example illustrated here.

For example, the area numbers for which the drawing end flag becomes "1" may be excluded from the determination target in order.

The order of determination regarding drawing possibility for each of the unit areas ar by the drawing control unit 814 may be set so as to shorten the time for waiting for the drying of ink to be shortest and perform drawing efficiently in consideration of drying time of ink, area of unit area ar to apply ink, the number of the other unit areas ar contacting with the unit area ar, and the like.

The embodiment has been described by taking, as an example, a configuration using a solenoid as the writing tool lifting mechanism which moves the writing tool 41 up and down; however, the configuration of writing tool lifting mechanism is not limited to this. For example, the writing tool lifting mechanism may be configured by a stepping motor, a DC motor, a motor and a ball screw.

The embodiment has been described by taking an example in which the X-direction movement stage 45 and the Y-direction movement stage 47 for moving the drawing head 42 are configured by combining the X-direction movement motor 46 and the Y-direction movement motor 48 which are stepping motors with the ball screw and the guide not shown in the drawings. However, the configuration for moving the drawing head 42 is not limited to this.

The X-direction movement motor 46 and the Y-direction movement motor 48 may be anything as long as they can move the drawing head 42 forward and backward and left and right at will. For example, the configuration may use a mechanism using a shaft, guide and wire as used in conventional inexpensive printers. Alternatively, the configuration may use a servomotor or the like.

The embodiment has been described by taking, as an example, a case where the drawing medium which is a sheet of paper is used for test writing of writing tools; however, the drawing medium is not limited to a sheet of paper.

The drawing medium may be roll type. In this case, the drawing medium is provided with a medium wheeling mechanism for wheeling the drawing medium to feed it automatically or manually. When the drawing medium is roll type, a medium attachment port for attaching and detaching the roll of drawing medium is provided instead of the medium inserting port 24.

The embodiment is described by taking, as an example, a case where the drawing data generation unit 813 performs curved surface correction for the image data of nail design and generates the drawing data. However, generating the drawing data by the drawing data generation unit 813 is not an essential configuration element of the present invention.

For example, drawing control may be performed so that the drawing control unit 814 does not generate drawing data separately and appropriately converts the image data of nail design with LUT (Lookup Table) or the like and outputs the converted data into the drawing head to perform drawing suitable for the nail shape.

The embodiment has been described by taking, as an example, a case where the shape of nail T is detected as nail information and the drawing data is generated on the basis of it. However, detecting the nail shape is not an essential configuration element of the present invention.

For example, when detecting the outline of nail T is not essential for drawing as in a case of drawing of a one-point pattern around the center of the nail T, accurate recognition of the shape of nail T is not necessary, and drawing can be performed without detecting the nail shape.

The photographing device is not limited to the cameras 51 photographing still images and may be a camera which can photograph a moving picture. In this case, the moving picture is photographed with the camera and the image of upper surface of nail T is appropriately cut out from the photographed moving picture to be used for detecting the nail information.

The embodiment has been described by taking, as an example, a case where the nail image storage area 821, the nail information storage area 822 and the nail design storage area 823 are provided in the storage unit 82 of the control device 80. However, the present invention is not limited to the case where the nail image storage area 821, the nail information storage area 822 and the nail design storage area 823 are provided in the storage unit 82 of the control device 80, and another storage unit may be provided.

The embodiment has been described by taking, as an example, the drawing apparatus 1 which performs drawing in order by inserting a single finger into the apparatus. However, the present invention can also be applied to an apparatus which can perform drawing continuously with respect to a plurality of fingers.

For example, by enlarging the movable range of writing tool to increase the drawable range, drawing can also be performed continuously with respect to the plurality of printing fingers U1.

Though several embodiments of the present invention have been described above, the scope of the present invention is not limited to the above embodiments, and includes the scope of inventions, which is described in the scope of claims, and the scope equivalent thereof.

What is claimed is:

1. A drawing apparatus, comprising:

a drawing unit which performs drawing of a design by applying inks of plural types to a drawing target area of a drawing target; and a control unit which controls the drawing unit based on image data of the design;

wherein:

the control unit sets a plurality of unit areas each of which has a contact part contacting with each other in the drawing target area based on the image data, the image data includes information regarding a drying time which is required for drying an ink applied to each of the plurality of the unit areas, the control unit determines a unit area, for which the drying time elapses after the ink is applied to the unit area, to be a dried unit area for which drying of the ink is supposed to be finished, and the control unit controls the drawing unit to perform drawing on a specific unit area of the plurality of the unit areas when the control unit determines that every unit area contacting with the specific unit area in the plurality of the unit areas is at least the dried unit area or an un-drawn unit area to which the ink is not applied.

2. The drawing apparatus according to claim 1, wherein each of the plurality of the unit areas is an area on which the drawing unit performs drawing with a single type of the ink.

3. The drawing apparatus according to claim 1, wherein two unit areas contacting with each other in the plurality of the unit areas are areas on which the drawing unit performs drawing with respective type inks, the respective type inks being different from each other.

4. The drawing apparatus according to claim 3, wherein respective colors of the respective type inks are different from each other.

5. The drawing apparatus according to claim 1, wherein:

the control unit has a drying notification timer, the drying time is set in the drying notification timer for each of the plurality of the unit areas, the drying notification timer counts an elapsed time from an end of the drawing by the drawing unit for each of the unit areas, and when the elapsed time reaches the drying time which is set for a unit area, the drying notification timer outputs a notification signal notifying reaching of the drying time to the control unit, and the control unit determines the unit area for which the notification signal is output from the drying notification timer to be the dried unit area.

6. The drawing apparatus according to claim 1, wherein:

the control unit provides area numbers which are different from each other to the respective plurality of the unit areas based on the image data and has the area numbers of the respective unit areas contacting with each other as surroundings relation information, the control unit obtains at least one area number of a unit area contacting with the specific unit area as a related area number based on the surroundings relation information, and the control unit determines whether or not the unit area corresponding to the obtained related area number is the dried unit area or the un-drawn unit area.

7. The drawing apparatus according to claim 1, wherein:

the control unit provides area numbers which are different from each other to the respective plurality of the unit areas based on the image data, the control unit sets each of the unit areas to be the specific unit area in order of the area numbers, and when the control unit determines that at least one unit area contacting with the specific unit area includes an un-dried unit area to which the ink is applied and drying of the ink is not finished, the control unit performs control not to perform the drawing on the specific unit area.

8. The drawing apparatus according to claim 1, wherein the drawing unit includes a drawing tool which contacts with the drawing target with a tip portion thereof and performs the drawing.

9. A drawing apparatus, comprising:

a drawing unit which performs drawing of a design by applying inks of plural types to a drawing target area of a drawing target; and a control unit which controls the drawing unit based on image data of the design;

wherein:

the control unit sets a plurality of unit areas each of which has a contact part contacting with each other in the drawing target area based on the image data, the control unit provides area numbers which are different from each other to the respective plurality of the unit areas based on the image data and has the area numbers of the respective unit areas contacting with each other as surroundings relation information, the control unit obtains at least one area number of a unit area contacting with a specific unit area as a related area number based on the surroundings relation information, the control unit determines whether or not the unit area corresponding to the obtained related area number is a dried unit area for which drying of the applied ink is supposed to be finished or an un-drawn unit area to which the ink is not applied, and the control unit controls the drawing unit to perform drawing on the specific unit area when the control unit determines that every unit area corresponding to the related area number is at least the dried unit area or the un-drawn unit area to which the ink is not applied.

10. A drawing apparatus, comprising:

a drawing unit which performs drawing of a design by applying inks of plural types to a drawing target area of a drawing target; and a control unit which controls the drawing unit based on image data of the design;

wherein:

the control unit provides area numbers which are different from each other to the respective plurality of the unit areas based on the image data, the control unit sets each of the unit areas to be a specific unit area in order of the area numbers, the control unit controls the drawing unit to perform drawing on the specific unit area of the plurality of the unit areas when the control unit determines that every unit area contacting with the specific unit area in the plurality of the unit areas is at least a dried unit area for which drying of the applied ink is supposed to be finished or an un-drawn unit area to which the ink is not applied, and when the control unit determines that at least one unit area contacting with the specific unit area includes an un-dried unit area for which drying of the applied ink is not supposed to be finished, the control unit performs control not to perform the drawing on the specific unit area.

* * * * *